US008686668B2

(12) United States Patent
Grotkowski et al.

(10) Patent No.: US 8,686,668 B2
(45) Date of Patent: Apr. 1, 2014

(54) CURRENT OFFSET CIRCUITS FOR PHASE-CUT POWER CONTROL

(75) Inventors: Miroslaw Marek Grotkowski, North Vancouver (CA); Milen Moussakov, New Westminster (CA); Gregory Bernard Sheehan, Delta (CA); Tom William Thornton, North Vancouver (CA); Thomas George Foxall, Surrey (CA)

(73) Assignee: Koninklijke Philips N.V., Eindhoven (NL)

( * ) Notice: Subject to any disclaimer, the term of this patent is extended or adjusted under 35 U.S.C. 154(b) by 332 days.

(21) Appl. No.: 13/093,700

(22) Filed: Apr. 25, 2011

(65) Prior Publication Data

US 2012/0098454 A1 Apr. 26, 2012

Related U.S. Application Data

(63) Continuation-in-part of application No. 12/912,613, filed on Oct. 26, 2010, now Pat. No. 8,283,875.

(60) Provisional application No. 61/363,161, filed on Jul. 9, 2010, provisional application No. 61/339,907, filed on Mar. 11, 2010, provisional application No. 61/279,750, filed on Oct. 26, 2009.

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |
| *H05B 41/16* | (2006.01) |
| *H05B 41/24* | (2006.01) |

(52) U.S. Cl.

USPC ..... 315/307; 315/246

(58) Field of Classification Search

None

See application file for complete search history.

(56) References Cited

U.S. PATENT DOCUMENTS

| | | | |
|---|---|---|---|
| 5,652,481 | A | 7/1997 | Johnson et al. |
| 5,955,847 | A | 9/1999 | Rothenbuhler |

(Continued)

FOREIGN PATENT DOCUMENTS

| | | | |
|---|---|---|---|
| GB | 1146776 | A | 3/1969 |
| WO | 9945750 | A1 | 9/1999 |

(Continued)

OTHER PUBLICATIONS

"LM3445 Off-Line TRIAC Dimmer LED Driver Demo Board", National Semiconductor Corporation, Application Note 1935, Apr. 14, 2009.

*Primary Examiner* — Douglas W Owens
*Assistant Examiner* — Dedei K Hammond

(57) ABSTRACT

Apparatus for maintaining at least a holding current in a leading-edge phase-cut dimmer during a period of transient voltage variations, the apparatus connectable to the dimmer and connectable to a load connected to draw current from the dimmer. The apparatus may comprise an edge detector connected to receive a voltage from the dimmer and generate a leading-edge signal in response to a leading-edge of a phase-cut waveform, and a current offset circuit connected to receive the leading-edge signal and draw a supplementary offset current in response to the leading-edge signal, wherein the supplementary offset current is sufficient to maintain at least a holding current in the dimmer during the period of transient voltage variations. The current offset circuit may comprise a holding current circuit which also draws supplementary current in response to an instantaneous value of load current.

20 Claims, 26 Drawing Sheets

(56) References Cited

U.S. PATENT DOCUMENTS

| | | | |
|---|---|---|---|
| 6,834,002 | B2 | 12/2004 | Yang |
| 7,102,902 | B1 | 9/2006 | Brown et al. |
| 7,696,698 | B2 | 4/2010 | Ghanem |
| 7,872,427 | B2 | 1/2011 | Scianna |
| 7,902,769 | B2 | 3/2011 | Shteynberg et al. |
| 2003/0197497 | A1 | 10/2003 | Barcelo et al. |
| 2008/0258647 | A1 | 10/2008 | Scianni |
| 2009/0115345 | A1 | 5/2009 | Steffie et al. |
| 2010/0090618 | A1 | 4/2010 | Veltman |
| 2011/0080112 | A1 | 4/2011 | Shearer et al. |
| 2011/0084622 | A1 | 4/2011 | Barrow et al. |
| 2011/0095700 | A1* | 4/2011 | Kanamori et al. ..... 315/291 |
| 2011/0115395 | A1 | 5/2011 | Barrow et al. |

FOREIGN PATENT DOCUMENTS

| | | | |
|---|---|---|---|
| WO | 0101385 | A1 | 1/2001 |
| WO | 2005115058 | A1 | 12/2005 |
| WO | 2009101544 | A2 | 8/2009 |
| WO | 2009134871 | A1 | 11/2009 |
| WO | 2010027254 | A1 | 3/2010 |

* cited by examiner

CURRENT OFFSET CIRCUITS FOR PHASE-CUT POWER CONTROL

REFERENCE TO RELATED APPLICATIONS

This application is a continuation-in-part of application Ser. No. 12/912,613 filed 26 Oct. 2010 and entitled "HOLDING CURRENT CIRCUITS FOR PHASE-CUT POWER CONTROL", which claims priority from U.S. Provisional Patent Application Ser. No. 61/363,161, filed 9 Jul. 2010 and entitled "DIMMABLE LED DRIVER," U.S. Provisional Patent Application Ser. No. 61/339,907, filed 11 Mar. 2010 and entitled "HIGH EFFICIENCY HOLDING CURRENT CIRCUIT FOR SOLID STATE LIGHTING APPLICATIONS," and U.S. Provisional Patent Application Ser. No. 61/279,750, filed 26 Oct. 2009 and entitled "LED OPTIMIZED SWITCHED MODE POWER SUPPLY". The benefit under 35 U.S.C. §119 and §120 of those applications are hereby claimed, and those applications are hereby incorporated herein by reference.

TECHNICAL FIELD

The invention relates to electrical circuits. More particularly, embodiments pertain to electrical circuits useful for maintaining holding currents in electrical circuits that draw current from phase-cut control power supplies.

BACKGROUND

Phase-cut AC power controls are used in a wide variety of applications. Phase-cut AC power controls trim an AC voltage waveform to control the application of power to a load circuit. The phase angle at which the AC voltage is trimmed may be referred to as the "conduction angle" or the "firing angle".

Some phase-cut power controls comprise circuits that include one or more thyristors, such as a TRIAC or a silicon controlled rectifier (SCR). A property of thyristors is that, once biased for conduction (turned on) by a gating pulse, they will remain in conduction for as long as they continue to conduct more than a threshold amount of current, commonly known as the holding current or hypostatic current. When the current in a thyristor drops below the holding current, the thyristor turns off and requires another gate pulse before it can turn on again.

In some applications, thyristor-based phase-cut power controls are used to deliver controlled power to a load. In some such applications, current drawn by the load may vary over time, due to, for instance, variations in the supply voltage and variations in load impedance. In such applications, the load current may at times be less than the holding current required to maintain thyristor conduction. Where insufficient load current causes a thyristor to come out of conduction, it may occur that a load receives less power than it should (e.g., the load may not receive the power from the portion of the AC cycle for which the thyristor came out of conduction).

Some prior art devices adjust the current drawn by a load in order to maintain a sufficient current to keep a thyristor in conduction. In some applications, this leads to additional power dissipation in the load that is not desired. For instance, dissipating additional power in an LED load causes the light produced by the LED load to be brighter. As a result, this manner of maintaining a thyristor in conduction may limit the extent to which an LED load can be dimmed.

Holding current circuits may be used adjunct to the load in order to draw a holding current from a thyristor. Some holding current circuits draw a constant holding current from the thyristor. Holding circuits that draw current constantly may negatively impact energy efficiency. Such impacts are particularly relevant where the intended load typically draws little power, such as, for example, an LED lighting load.

SUMMARY

The following embodiments and aspects thereof are described and illustrated in conjunction with systems, tools and methods which are meant to be exemplary and illustrative, not limiting in scope.

One aspect provides a holding current circuit for maintaining at least a holding current in a dimmer. The circuit is connectable to the dimmer a load connected to draw current from a dimmer. The circuit comprises a controlled current source connectable to draw current from the dimmer in accordance with a control signal, a conduction monitor operable to generate a conduction monitor signal indicative of a conduction state of the dimmer, a current monitor connected to receive at least a portion of the current drawn by the controlled current source and connectable to receive at least a portion of a load current drawn from the dimmer by the load and operable to generate a current monitor signal indicative of a magnitude of the current in the current monitor, and, a current controller configured to generate the control signal based on the conduction monitor signal and the current monitor signal to cause the controlled current source to draw a supplementary current at least as great as a difference between the holding current and the load current when the dimmer is in conduction and the load current is less than the holding current.

One aspect provides a holding current circuit for maintaining at least a holding current in a dimmer. The circuit is connectable to the dimmer and a load connected to draw current from a dimmer. The circuit comprises a voltage reference configured to provide a reference voltage dependent on a conduction state of the dimmer, a voltage controlled current source connectable to draw current from the dimmer, a current-to-voltage converter connected to conduct at least part of the current from the voltage controlled current source and connectable to conduct at least part of a load current drawn from the dimmer by the load. The controlled current source is controlled by a voltage difference between the reference voltage and a voltage across the current-to-voltage converter, and the controlled current source, voltage reference and current-to-voltage converter are configured such that when the current-to-voltage converter is connected to conduct at least part of the load current and the dimmer is in conduction and the load current is less than the holding current, the voltage difference between the reference voltage and the voltage across the current-to-voltage converter causes the controlled current source to draw a current at least as great as the difference between the holding current and the load current.

One aspect provides a method for maintaining at least a holding current in a dimmer which provides power to a load. The method comprises providing a controlled current source connected in parallel with the load, providing a current monitor connected in series with the controlled current source and the load such that at least a portion of a load current drawn from the dimmer by the load flows through the current monitor, the current monitor configured to generate a current monitor signal indicative of a magnitude of the current through the current monitor, generating a conduction monitor signal indicative of a conduction state of the dimmer, and, controlling the controlled current source to selectively draw an amount of supplementary current based on the current monitor signal and the conduction monitor signal, wherein the amount of supplementary current is at least as great as a difference between the holding current and the load current when the dimmer is in conduction and the load current is less than the holding current.

One aspect provides an LED lighting assembly connectable to a dimmer. The assembly comprises an LED lighting module connectable to draw a load current from the dimmer, and a holding current circuit comprising a controlled current source connectable to draw current from the dimmer in accordance with a control signal, a conduction monitor operable to generate a conduction monitor signal indicative of a conduction state of the dimmer, a current monitor connected to receive at least a portion of the current drawn by the controlled current source and connected to receive at least a portion of the load current, the current monitor operable to generate a current monitor signal indicative of a magnitude of the current in the current monitor, and, a current controller configured to generate the control signal based on the conduction monitor signal and the current monitor signal to cause the controlled current source to draw a supplementary current at least as great as a difference between the holding current and the load current when the dimmer is in conduction and the load current is less than the holding current.

One aspect provides a method for maintaining at least a holding current circuit in a dimmer. The method comprises determining a conduction state of the dimmer, and, when the dimmer is in conduction and the current in the dimmer current is less than the holding current, drawing more current from the dimmer using a controlled current source.

One aspect provides apparatus for maintaining at least a holding current in a leading-edge phase-cut dimmer during a period of transient voltage variations, the apparatus connectable to the dimmer and connectable to a load connected to draw current from the dimmer. The apparatus may comprise an edge detector connected to receive a voltage from the dimmer and generate a leading-edge signal in response to a leading-edge of a phase-cut waveform, and a current offset circuit connected to receive the leading-edge signal and draw a supplementary offset current in response to the leading-edge signal, wherein the supplementary offset current is sufficient to maintain at least a holding current in the dimmer during the period of transient voltage variations. The current offset circuit may comprise a holding current circuit which also draws supplementary current in response to an instantaneous value of load current.

One aspect provides a method for maintaining at least a holding current in a leading-edge phase-cut dimmer during a period of transient voltage variations. The method comprises generating a leading-edge signal in response to a leading-edge of a phase cut waveform, and, drawing a supplementary offset current from the dimmer through a current offset circuit in response to the leading-edge signal, wherein the supplementary offset current is sufficient to maintain at least a holding current in the dimmer during the period of transient voltage variations.

One aspect provides apparatus for maintaining at least a holding current in a leading-edge phase-cut dimmer, the apparatus connectable to the dimmer and connectable to a load connected to draw current from the dimmer. The apparatus comprises an edge detector connected to receive a voltage from the dimmer and generate a leading-edge signal in response to a leading-edge of a phase-cut waveform, and, a holding current and offset circuit comprising a controlled current source connectable to draw current from the dimmer, a current monitor connected to receive at least a portion of the current drawn by the controlled current source and connectable to receive at least a portion of a load current drawn from the dimmer by the load, the current monitor operable to generate a current monitor signal indicative of a magnitude of the current in the current monitor, wherein the controlled current source is connected to receive the current monitor signal and is configured to draw a supplementary current at least as great as a difference between the holding current and the load current when the load current is less than the holding current, and wherein the holding current and offset circuit is connected to receive the leading-edge signal and draw a supplementary offset current in response to the leading-edge signal, wherein the supplementary offset current is sufficient to maintain at least a holding current in the dimmer during a period of transient voltage variations.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Certain embodiments of the invention provide improved holding current circuits for ensuring that a phase-cut dimmer does not drop out of conduction prematurely as current drawn by a load decreases. As described in detail below, some embodiments provide holding current circuits which are configured to draw only as much supplemental current as necessary to ensure that at least a holding current is maintained in the dimmer. Some embodiments provide holding current circuits which are configured to only draw supplementary current when the dimmer is in conduction. Holding current circuits according to some embodiments thus provide improved energy efficiency in comparison to certain prior art holding current circuits.

Figure 1A:
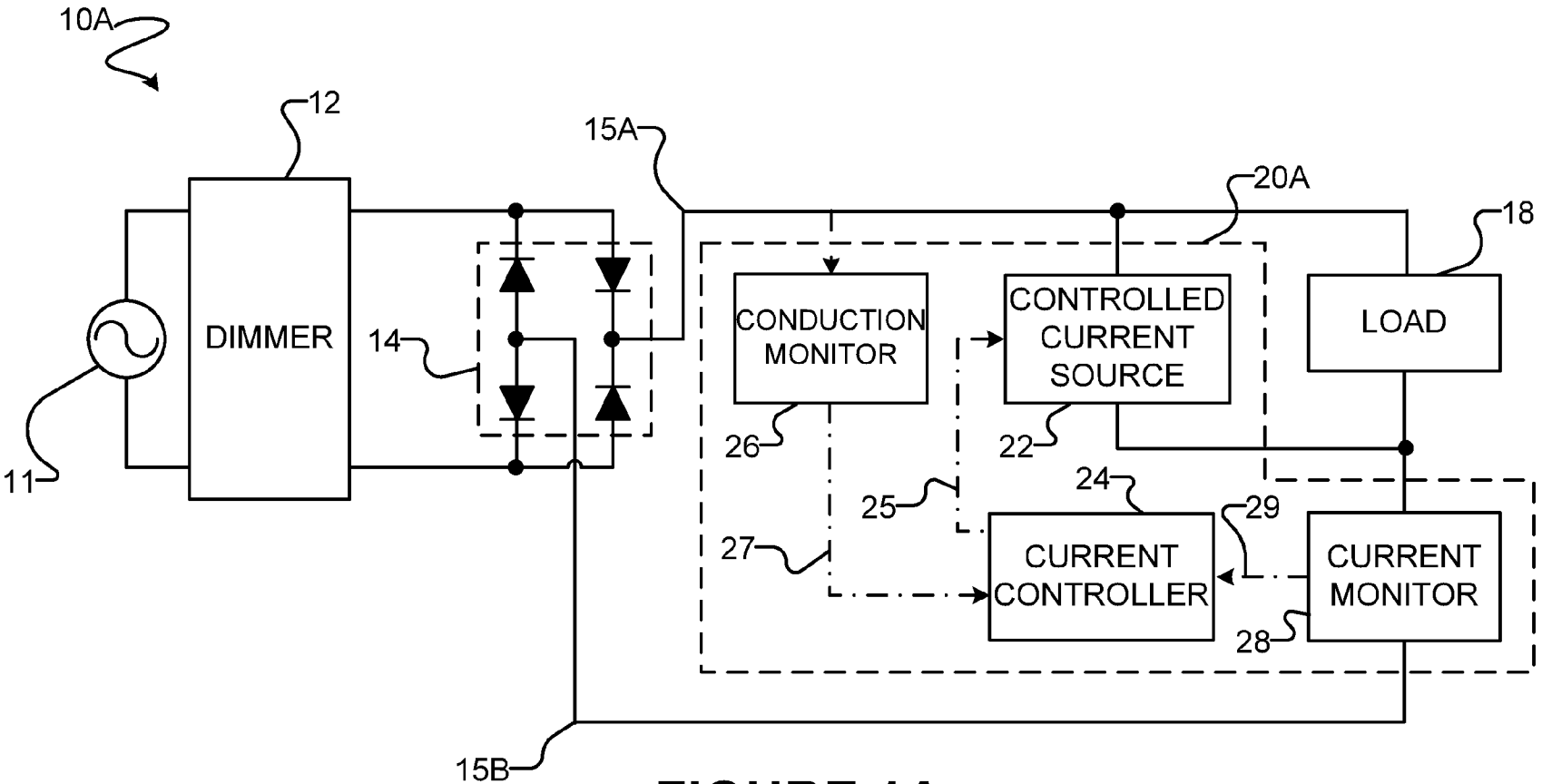
FIG. 1A is a block diagram of an electrical circuit comprising a holding current circuit according to an example embodiment.

FIG. 1A is a block diagram of an electrical circuit 10A comprising a holding current circuit 20A that corresponds to some (but not all) example embodiments. An AC voltage source 11 is connected to inputs of a dimmer 12. Dimmer 12 comprises a TRIAC, SCR or other thyristor. The outputs of dimmer 12 are connected to inputs of a diode bridge rectifier 14. One output of diode bridge rectifier 14 is connected to a voltage supply rail 15A. Another output of diode bridge rectifier 14 is connected to a return rail 15B. A load 18 is connected between voltage supply rail 15A and a control input of holding current circuit 20A. Load 18 may be a variable load. Load 18 may comprise a light source, components for controlling and/or conditioning the supply of power to the light source (e.g., a controller, a switched mode power supply, etc.), and the like. Holding current circuit 20A is connected between voltage supply rail 15A and return rail 15B.

In some embodiments, dimmer 12 comprises a leading-edge phase-cut dimmer, wherein a leading portion of a half wave is cut. In such embodiments, it may occur that the current drawn by load 18 decreases near the end of the half-wave power cycle (e.g., due to the time-varying voltage provided by source 11 and/or characteristics of load 18). In some instances, the current drawn by load 18 may be insufficient to maintain the thyristor of dimmer 12 in conduction for a trailing part of the 'on' portion of the phase-cut power cycle. Holding current circuit 20A is operable to draw current from supply rail 15A so that the thyristor of dimmer 12 is maintained in conduction in circumstances where the current drawn by load 18 is not alone sufficient to do so.

Holding current circuit 20A comprises a controlled current source 22, a current controller 24, a conduction monitor 26 and a current monitor 28. Controlled current source 22 is connected in parallel with load 18 and in series with current monitor 28. Controlled current source 22 may draw current through dimmer 12. Controlled current source 22 may be a secondary source (i.e., a source that dissipates or merely transfers power). Where an element is referred to using the term "controlled current source" or the term "controlled voltage source" (including use in the contexts "voltage controlled current source" and "current controlled voltage source"), that element may comprise a secondary source unless otherwise indicated.

Current monitor 28 is connected in series with the parallel connection of load 18 and controlled current source 22. The current in current monitor 28 is the sum of the currents in controlled current source 22 and load 18. Current monitor 28 is operable to provide a current monitor signal 29 that is indicative of the current through current monitor 28. It will be appreciated that in embodiments where load 18 and controlled current source 22 are the only components drawing appreciable current from dimmer 12, the current in current monitor 28 is practically the same as the current in dimmer 12 and current monitor signal 29 is strongly indicative of the current in dimmer 12. Current monitor signal 29 is provided to current controller 24.

Conduction monitor 26 is configured to generate a conduction monitor signal 27 that is indicative of the conduction state of dimmer 12. In FIG. 1A conduction monitor 26 is shown as coupled to supply rail 15A, but it is to be understood that in other embodiments conduction monitor 26 may be coupled to any suitable source from which conduction monitor signal 27 may be generated (e.g., a voltage signal taken from between AC source 12 and diode bridge rectifier 14, an optical signal derived from dimmer 12, etc.). Conduction monitor signal 27 is provided to current controller 24.

In some embodiments conduction monitor 26 may be configured to generate a binary conduction monitor signal 27. For example, conduction monitor 26 may be configured to generate a binary conduction monitor signal 27 that tracks the conduction state of dimmer 12. In an example embodiment, conduction monitor 26 is connected to supply rail 15A and configured to generate a binary conduction monitor signal 27 that is a first value (e.g., logic high) when the voltage on supply rail 15A is greater than a threshold voltage (e.g., when dimmer 12 is conducting current at a non-zero voltage), and that is a second value (e.g., logic low) otherwise (e.g., when dimmer 12 is not in conduction). In some embodiments, the threshold voltage may be zero or near zero.

In some embodiments, a binary conduction monitor signal 27 leads the conduction angle of dimmer 12 (e.g., the binary conduction monitor signal 27 may transition to logic high a pre-determined time before dimmer 12 is triggered into conduction). In some embodiments, a binary conduction monitor signal 27 lags the conduction angle of dimmer 12 (e.g., the binary conduction monitor signal 27 may transition to logic high a pre-determined time after dimmer 12 is triggered into conduction).

Current controller 24 is configured to generate a control signal 25 based on conduction monitor signal 27 and current monitor signal 29. Control signal 25 is provided to controlled current source 22 to control the amount of current drawn through controlled current source 22.

In some embodiments, current controller 24 is configured to generate control signal 25 for binary control of controlled current source 22 based on conduction monitor signal 27 (e.g., current controller 24 may be configured to turn 'on' controlled current source 22 according to conduction monitor signal 27). In some embodiments, current controller 24 is configured to generate control signal 25 for controlling the magnitude of current drawn through controlled current source 22 based on current monitor signal 29. In some embodiments, effect of current monitor signal 29 on control signal 25 is subordinate to the effect of conduction monitor signal 27.

When dimmer 12 is not in conduction there is no need for holding current circuit 20A to draw additional current (i.e., there is no conduction in dimmer 12 to maintain). In some embodiments, current controller 24 is configured to generate control signal 25 such that controlled current source 22 does not pass current when dimmer 12 is not in conduction (e.g., during the 'off' portion of a phase-cut voltage half-wave). For example, in an embodiment where dimmer 12 comprises a leading-edge phase-cut dimmer, current controller 24 is configured to generate control signal 25 such that current source 22 passes current only during the portion of each voltage half-wave that trails the conduction angle (i.e., the portion of the voltage half-wave passed by dimmer 12).

The current in controlled current source 22, current monitor signal 29 and control signal 25 constitute a feedback loop. Controlled current source 22 and current controller 24 may be configured to maintain at least a pre-determined current level in current monitor 28. Since the current in current monitor 28 is drawn from dimmer 12, the current level maintained in current monitor 28 is also maintained in dimmer 12. Current controller 24 may be stateless or state-based. In some embodiments, the pre-determined current level maintained in current monitor 28 may be slightly higher than the hypostatic current of dimmer 12 over a range of operating temperatures, in order to provide a buffer to avoid dimmer 12 dropping out of conduction before holding current circuit 20A begins drawing additional current. As those skilled in the art will appreciate, the pre-determined current level maintained in current monitor 28 may be selected based on the particular characteristics of dimmer 12 and the components used to implement holding current circuit 20A.

In some embodiments, current controller 24 is configured to cause controlled current source 22 to selectively pass current to maintain a pre-determined current level in current monitor 28 for at least part of the portion of the power-cycle in which dimmer 12 is in conduction. For example, current controller 24 may be configured to generate control signal 25 such that controlled current source 22 does not pass current when dimmer 12 is 'off', and passes current when dimmer 12 is 'on' when current in load 18 is less than a holding current that would maintain dimmer 12 in conduction. For greater clarity, as used herein, the term "holding current" means a current that is at least sufficient to maintain a dimmer in conduction.

In some embodiments, when dimmer 12 is in conduction, as the current in current monitor 28 drops (e.g. near the trailing edge of the voltage waveform) and approaches the holding current, current controller 24 may be configured to generate control signal 25 to cause controlled current source 22 to draw a current equal to the holding current. This would ensure that at least the holding current is always drawn though dimmer 12. In some embodiments, when dimmer 12 is in conduction, as the current in current monitor 28 drops (e.g. near the trailing edge of the voltage waveform) and approaches the holding current, current controller 24 is configured to generate control signal 25 to cause controlled current source 22 to draw a current less than the holding current. In some embodiments, improved energy efficiency may be achieved by generating control signal 25 to cause controlled current source 22 to draw a current equal to or slightly greater than the difference between the holding current and the current drawn by load 18.

In some embodiments, the current drawn by controlled current source 22 may be controlled to increase smoothly as the current drawn by load 18 decreases. In some embodiments, the current drawn by controlled current source 22 may be controlled to increase stepwise as the current drawn by load 18 decreases. As those skilled in the art will appreciate, a variety of manners of controlling the current drawn by controlled current source 22 may be employed, so long as the combined current drawn by load 18 and controlled current source 22 is at least the holding current.

In some embodiments, current controller 24 is configured such that the current in controlled current source 22 is negatively related to the current in current monitor 28, at least for a range of current in current monitor 28, when dimmer 12 is in conduction. In some such embodiments, the range of current in current monitor 28 for which the current in controlled current source 22 is negatively related to the current in current monitor 28 runs from zero current to at least the holding current. In some embodiments, the magnitude of control signal 25 is positively related to the magnitude of the current in current monitor 28 and the magnitude of the current in controlled current source 22 is negatively related to the magnitude of control signal 25, at least when the current in current monitor 28 is less than the holding current. In other embodiments, the magnitude of control signal 25 is negatively related to the magnitude of the current in current monitor 28 and the magnitude of the current in controlled current source 22 is positively related to the magnitude of control signal 25, at least when the current in current monitor 28 is less than the holding current.

Figure 10:
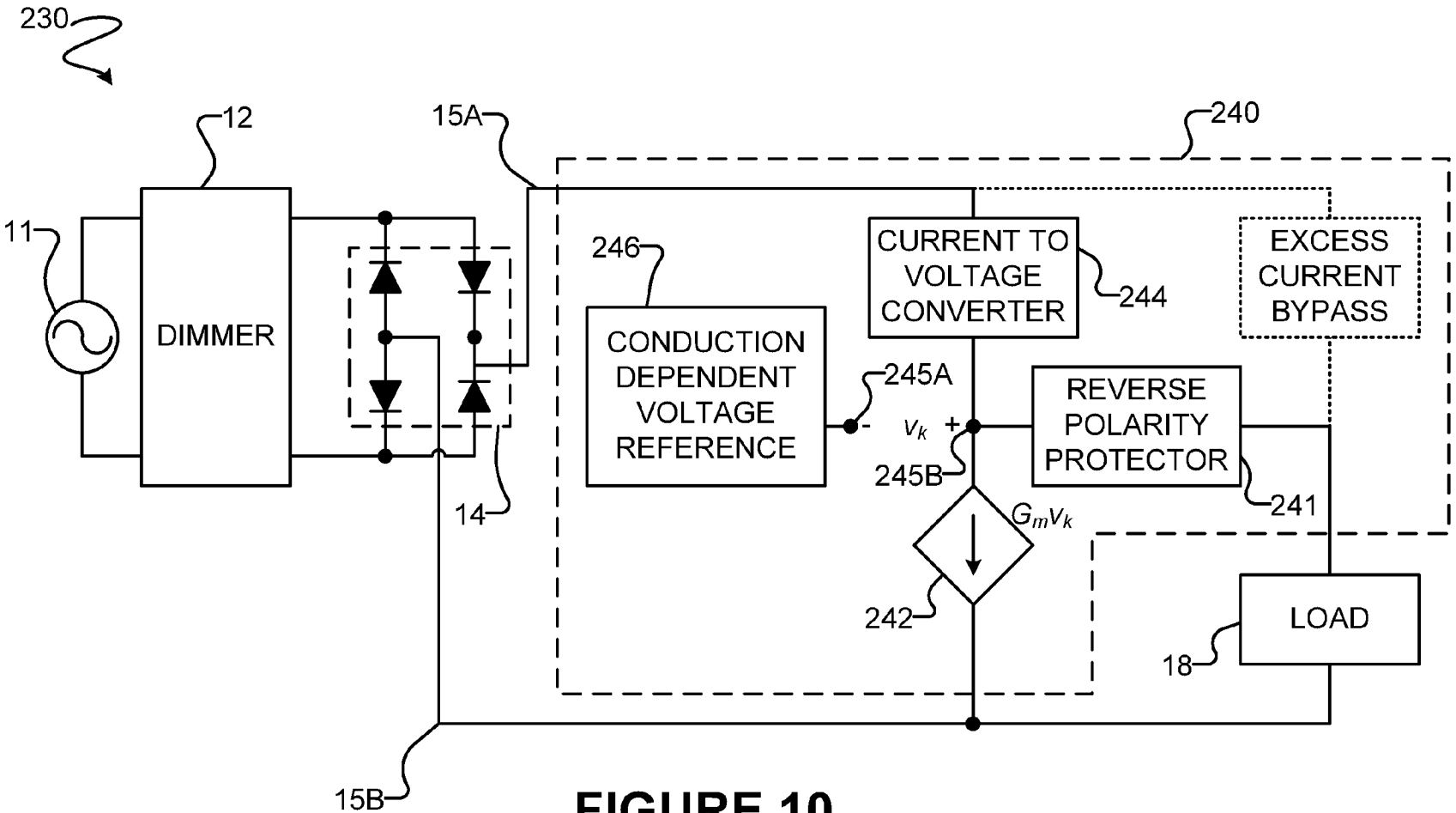
FIG. 10 is a block diagram of an electrical circuit comprising a holding current circuit according to an example embodiment.

In circuit 10A, conventional current flows from the parallel connection of controlled current source 22 and load 18 into current monitor 28. In some embodiments, a holding current circuit is configured such that conventional current flows from a current monitor into a parallel connection of a controlled current source and a load. FIG. 10 shows an example of such a circuit.

Figure 1B:
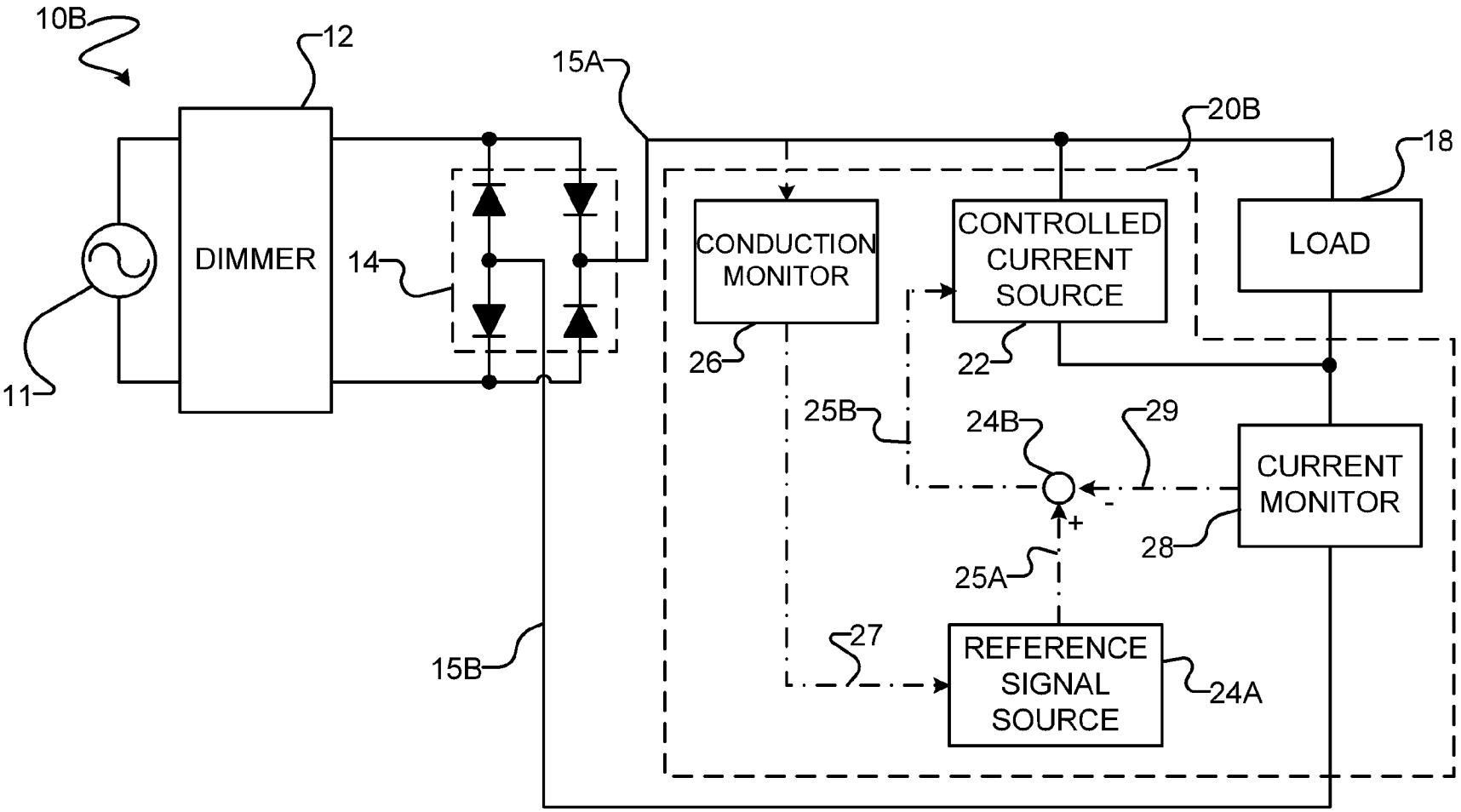
FIG. 1B is a block diagram of an electrical circuit comprising a holding current circuit according to an example embodiment.

FIG. 1B is a block diagram of an electrical circuit 10B comprising an example holding current circuit 20B that corresponds to some (but not all) embodiments. Holding current circuit 20B is similar in several respects to holding current circuit 20A. Holding current circuit 20B has a number of elements in common with holding current circuit 20A of FIG. 1A, which elements are labeled with the same reference numerals and will not be described in detail again. Holding current circuit 20B differs from holding current circuit 20A in that holding current circuit 20B comprises a reference signal source 24A and a subtractor 24B in place of current controller 24. Conduction monitor signal 27 is provided to reference signal source 24A and current monitor signal 29 is provided to a first input of subtractor 24B. Reference signal source 24A provides a conduction dependent reference signal 25A to a second input of subtractor 24B. Subtractor 24B subtracts current monitor signal 29 from reference signal 25A to yield a control signal 25B. Control signal 25B is provided to controlled current source 22 to control the amount of current drawn through controlled current source 22.

Reference signal source 25A may be configured so that when dimmer 12 is not in conduction, conduction dependent reference signal 25A is less than current monitor signal 29. For example, reference signal source 24A may be configured so that when dimmer 12 is not in conduction, conduction dependent reference signal 25A is zero-valued. Where reference signal source 24A is so configured, control signal 25A will be zero-valued when dimmer 12 is not in conduction.

The current in controlled current source 22, current monitor signal 29, and control signal 25B constitute a feedback loop. In some embodiments, as current in controlled current source 22 increases, the difference between reference signal 24A and current monitor signal 29 shrinks, and the resulting control signal 25B causes controlled current source 22 to draw less current. Reference signal source 24A may be configured so that when dimmer 12 is in conduction and the current in load 18 is less than a holding current, an equilibrium is reached in which controlled current source 22 passes sufficient current to maintain at least the holding current though current monitor 28. In some embodiments, reference signal source 24A is configured so that when dimmer 12 is in conduction and the current in load 18 is less than the holding current, an equilibrium is reached in which controlled current source 22 passes a current equal to the difference between the holding current and the current in load 18.

Figure 1C:
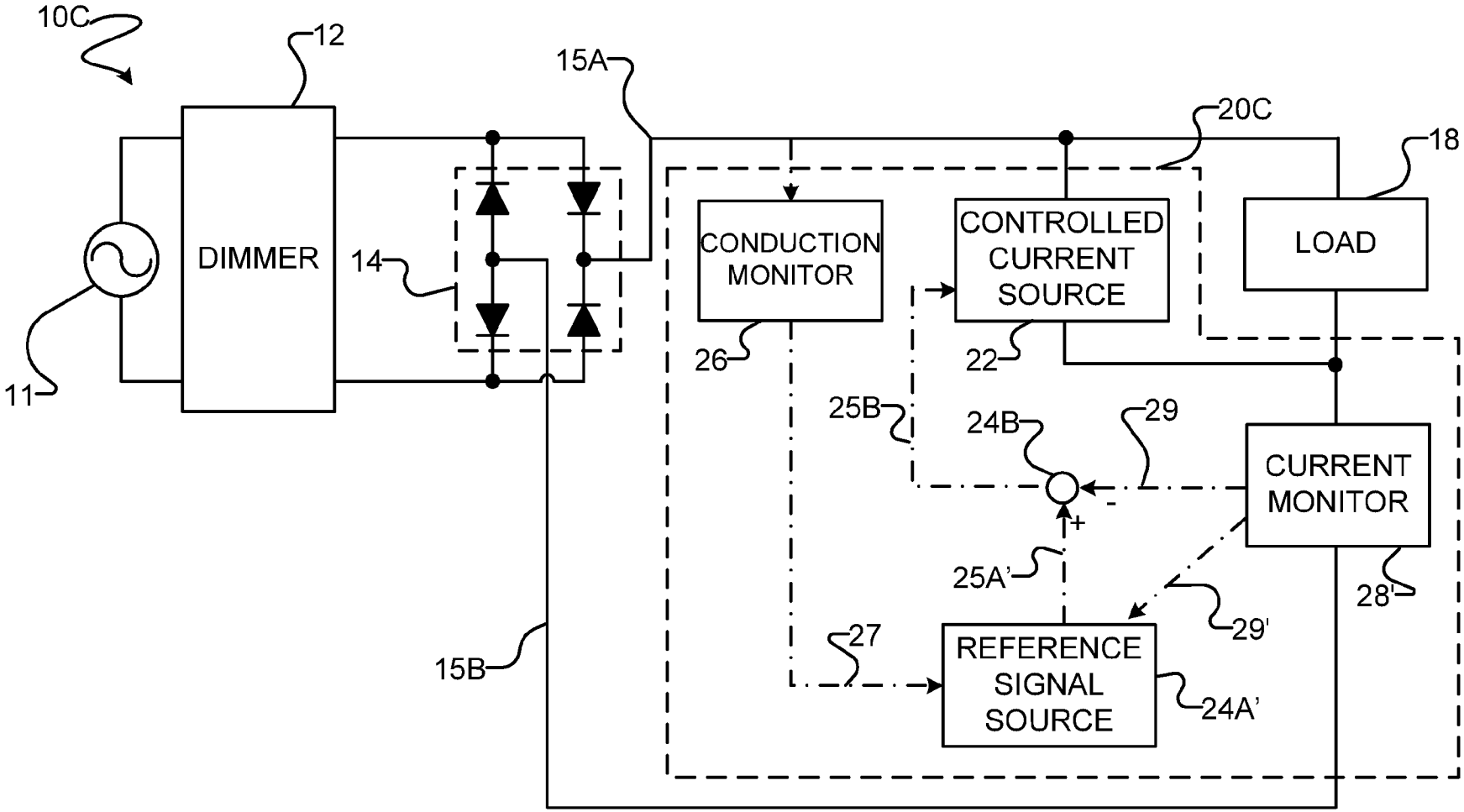
FIG. 1C is a block diagram of an electrical circuit comprising a holding current circuit according to an example embodiment.

FIG. 1C is a block diagram of an electrical circuit 10C comprising an example holding current circuit 20C that corresponds to some (but not all) embodiments. Holding current circuit 20C is similar in several respects to holding current circuit 20B. Holding current circuit 20C has a number of elements in common with holding current circuit 20B of FIG. 1B, which elements are labeled with the same reference numerals and will not be described in detail again. Holding current circuit 20C differs from holding current circuit 20B in that holding current circuit 20C comprises a current monitor 28' and a reference signal source 24A' that differ from current monitor 28 and reference signal source 24A, respectively. Current monitor 28' generates current monitor signals 29 and 29'. Current monitor signals 29 and 29' may be the same or different; both are indicative of the current through current monitor 29. Current monitor signals 29 and 29' are provided to subtractor 24B and reference signal source 24A', respectively. Reference signal source 24A' provides a conduction dependent reference signal 25A' to subtractor 24B. Reference signal source 24A' is configured to generate reference signal 25A' based at least in part on conduction monitor signal 27 and current monitor signal 29'. Subtractor 24B subtracts current monitor signal 29 from current reference signal 25A' to yield control signal 25B.

Holding current circuit 20C operates in a manner similar to holding current circuit 20B. A difference between the operation of holding current circuit 20C and the operation of holding current circuit 20B is that in holding current circuit 20C both inputs to subtractor 24B, namely current monitor signal 29 and reference signal 25A', are based, at least in part, on the current in current monitor 28'. In some embodiments, as current in controlled current source 22 increases, the difference between current reference signal 25A' and current monitor signal 29 shrinks as a result of changes to both reference signal 25A' and current monitor signal 29 (e.g., reference signal 25A' may decrease as current monitor signal 29 increases). In comparison with holding current circuit 20B, holding current circuit 20C may cause controlled current source 22 to respond more quickly to changes in the current in current monitor 28'.

In holding current circuits 20A, 20B and 20C, signals 25, 25A, 25A', 25B, 27, 29 and 29' may comprise analog or digital signals. Signals 25, 25A, 25A', 25B, 27, 29 and 29' may be embodied in electrical, magnetic, optical, or other forms. For example, in some embodiments these signals may comprise analog voltages and/or currents. Controlled current source 22, current controller 24, reference signal sources 24A, 24A', conduction monitor 26 and current monitors 28, 28' may comprise components suitable for receiving and/or generating various forms of signals, and may comprise active and/or passive components. For example, one or more of controlled current source 22, current controller 24, reference signal sources 24A, 24A', conduction monitor 26 and current monitors 28, 28' may comprise or be implemented as part of a digital logic circuit, microprocessor, microcontroller, FPGA, programmable logic controller, or the like. Combinations of components of holding current circuits 20A, 20B and 20C may be provided in a single physical package, such as, for example, an integrated circuit.

Figure 2:
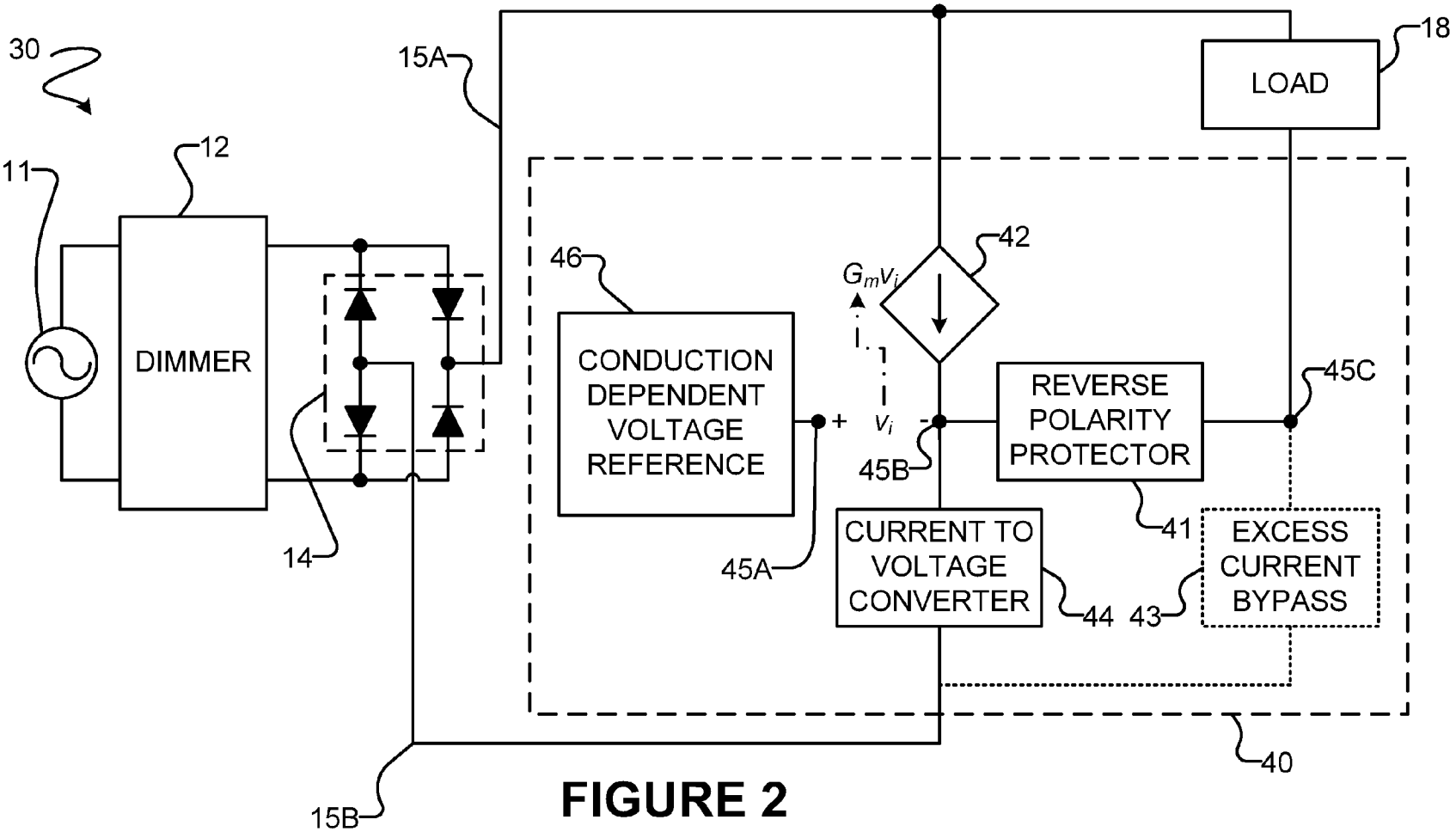
FIG. 2 is a block diagram of an electrical circuit comprising a holding current circuit according to an example embodiment.

FIG. 2 is block diagram of an electrical circuit 30 comprising a holding current circuit 40 that corresponds to some (but not all) example embodiments. Holding current circuit 40 comprises a conduction dependent voltage reference 46. An output of conduction dependent voltage reference 46 provides a conduction dependent reference voltage at node 45A. Conduction dependent voltage reference 46 is configured to provide two or more different reference voltages at different times based on the timing of changes to the conduction state of dimmer 12. Conduction dependent voltage reference 46 may be configured to detect information about the conduction state of dimmer 12 based on voltage and/or current passed by dimmer 12. For example, conduction dependent voltage reference 46 may be connected to receive rectified, unfiltered AC voltage passed by dimmer 12 (such as by being connected to voltage supply rail 15A, for example). In some embodiments, conduction dependent voltage reference 46 is connected between voltage supply rail 15A and return rail 15B.

Conduction dependent voltage reference 46 may be configured so that the reference voltage it provides changes at the conduction angle of dimmer 12. For example, conduction dependent voltage reference 46 may be configured to generate a first reference voltage when the voltage on supply rail 15A is greater than a threshold voltage (e.g., when dimmer 12 is conducting current at a non-zero voltage), and to generate a second reference voltage different from the first reference voltage otherwise (e.g., when dimmer 12 is not in conduction). It will be appreciated that where the voltage on supply rail 15A increases past the threshold voltage at the conduction angle, the voltage reference will switch from the second reference voltage to the first reference voltage at the conduction angle. The threshold voltage may be zero or near zero. In some embodiments, the second reference voltage is the same as the voltage at return rail 15B.

The different reference voltages that conduction dependent voltage reference 46 is configured to provide at node 45A may be stable, variable (e.g., controllable), or a combination thereof. For example, conduction dependent voltage reference 46 may be configured to provide a variable voltage before the conduction angle of dimmer 12 and to provide a stable voltage after the conduction angle of dimmer 12. In some embodiments, conduction dependent voltage reference 46 is configured to provide an uncontrolled variable voltage before the conduction angle of dimmer 12 and to provide a controlled variable voltage after the conduction angle of dimmer 12.

In some embodiments, conduction dependent voltage reference 46 is configured to change the reference voltage it provides at node 45A ahead of the conduction angle of dimmer 12. In some embodiments, conduction dependent voltage reference 46 is configured to change the reference voltage it provides at node 45A after the conduction angle of dimmer 12. Conduction dependent voltage reference 46 may be configured to time the change in a reference voltage that it provides by triggering a timer (e.g., an analog timing circuit, a digital timer in a microcontroller or the like, etc.) at the conduction angle and changing the reference voltage when the timer expires, for example.

Holding current circuit 40 comprises a voltage controlled current source 42 connected between voltage supply rail 15A and node 45B. Controlled current source 42 is configured to selectively draw current from dimmer 12. In the illustrated embodiment, controlled current source 42 is configured to conduct conventional current in the indicated direction only. Controlled current source 42 is controlled by the voltage difference between nodes 45A and 45B. In particular, the current in controlled current source 42 is related by gain factor $G_m$ to the difference $v_i$ between the voltage at node 45A and the voltage at node 45B. An arrow drawn in stippled line shows the dependence relationship of the current $G_m v_i$ in controlled current source 42 on the voltage $v_i$ between nodes 45A and 45B.

A current-to-voltage converter 44 is connected between node 45B and return rail 15B. Current-to-voltage converter 44 converts the current through it into a voltage across it, which appears at node 45B. An optional reverse polarity protector 41 is connected between the output of load 18 (the control input of holding current circuit 40) and node 45B. Reverse polarity protector 41 is configured to conduct current from the output of load 18 to node 45B. When reverse polarity protector 41 is conducting, the current in current-to-voltage converter 44 is the sum of the currents in controlled current source 42 and load 18. Current-to-voltage converter 44 thus functions as a current monitor.

The parallel connection of controlled current source 42 and load 18 is in series with current-to-voltage converter 44 such that the current in current-to-voltage converter 44 is generally the sum of the currents in load 18 and controlled current source 42. Since the voltage developed across current-to-voltage converter 44 appears at node 45B, the current in controlled current source 42, which depends on the voltage difference between nodes 45A and 45B, depends on the sum of currents in load 18 and controlled current source 42.

Holding current circuit 40 may be regarded as an implementation of holding current circuit 20B. Current-to-voltage converter 44 acts as a current monitor, developing a voltage at node 45B (a current monitor signal) proportional to (and therefore indicative of) the current through current-to-voltage converter 44. Conduction dependent voltage reference 46 acts as a conduction monitor and reference signal source, generating a conduction dependent reference voltage at node 45A. By drawing current based on the difference between the voltages at nodes 45A and 45B, controlled current source 42 compares a reference signal with a current monitor signal, which yields a control signal (internal to controlled current source 42) that controls the current through controlled current source 42.

It will be appreciated that the configuration of holding current circuit 40 provides a negative feedback loop on the control of controlled current source 42. In operation, when the current through load 18 is sufficiently small to cause a current in current-to-voltage converter 44 that results in a voltage at node 45B less than the voltage at node 45A, controlled current source 42 draws current from supply voltage rail 15A to supply additional current to current-to-voltage converter 44. The current added by controlled current source 42 to the current in current-to-voltage converter 44 causes the voltage across current-to-voltage converter 44 to increase, resulting in an increase in the voltage at node 45B, which throttles the current in controlled current source 42. Thus the series connection of controlled current source 42 and current-to-voltage converter 44 and the dependence of the current in voltage controlled current source 42 on the voltage across current-to-voltage converter 44 constitutes a feedback loop, which stabilizes the current in controlled current source 42.

Conversely, when the current through load 18 is sufficiently large, the current in current-to-voltage converter 44 will result in a voltage at node 45B greater than the reference voltage at node 45A, under which condition controlled current source 42 draws no current from supply rail 15A and dimmer 12.

In the illustrated embodiment, the current in controlled current source 42 is positively related to the voltage difference between nodes 45A and 45B (and thus negatively related to the voltage at node 45B) and current-to-voltage converter 44 converts current to voltage according to a positive relationship. In some embodiments, the current in controlled current source 42 is substantially linearly related to the voltage difference between nodes 45A and 45B. In some embodiments, the relationship between the current in controlled current source 42 and the voltage difference between nodes 45A and 45B is non-linear. In some embodiments, current-to-voltage converter 44 converts current to voltage according to a substantially linear relationship (e.g., Ohm's law). In some embodiments, current-to-voltage converter 44 converts current to voltage according to a non-linear relationship.

In some embodiments, the current in controlled current source 42 is negatively related to the voltage difference between nodes 45A and 45B (e.g., the current in controlled current source may follow a relationship such as $G_m/v_i$), and current-to-voltage converter 44 converts current to voltage according to a negative relationship.

Controlled current source 42, current-to-voltage converter 44 and conduction dependent voltage reference 46 may be configured so that controlled current source 42 selectively passes current to maintain a pre-determined equilibrium current level in current-to-voltage converter 44 for at least part of the portion of the power-cycle in which dimmer 12 is in conduction. In some embodiments, controlled current source 42, current-to-voltage converter 44 and conduction dependent voltage reference 46 are configured such that controlled current source 42 does not pass current when dimmer 12 is 'off', and passes current when dimmer 12 is 'on' when current in load 18 is less than a holding current required to maintain dimmer 12 in conduction. For example, conduction dependent voltage reference 46 may be configured to provide a first reference voltage at node 45A that is equal to the voltage on return rail 15A when dimmer 12 is not in conduction, and may be configured to provide a second reference voltage at node 45A that is greater than the voltage on return rail 15B when dimmer 12 is in conduction. In some embodiments, current-to-voltage converter 44 is configured so that the voltage at node 45B is equal to the second reference voltage when the current in current-to-voltage converter 44 is equal to the holding current.

Holding current circuit 40 comprises an optional excess current bypass 43 connected between node 45C and return rail 15B. Thus excess current bypass 43 is connected in parallel with the series connection of reverse polarity protector 41 and current-to-voltage converter 44. Excess current bypass 43 is configured to shunt current away from the series connection of reverse polarity protector 41 and current-to-voltage converter 44 when the current in load 18 is greater than an excess current threshold.

It will be appreciated that the current in the series connection of reverse polarity protector 41 and current-to-voltage converter 44 is related to the voltage at node 45C. Excess current bypass 43 is configured to conduct whenever the voltage difference between node 45C and return rail 15B is greater than a threshold voltage corresponding to an excess current threshold for the series connection of reverse polarity protector 41 and current-to-voltage converter 44. In some embodiments, excess current bypass 43 has a lower impedance when conducting than current-to-voltage converter 44. In such embodiments, the operation of excess current bypass 43 may advantageously reduce power dissipation in current-to-voltage converter 44 that would otherwise occur when the current in load 18 is high. The presence of excess current bypass 43 may permit reverse polarity protector 41 and/or current-to-voltage converter 44 to include components which are rated for lower power and/or current that would otherwise be required without excess current bypass 43.

Figure 3:
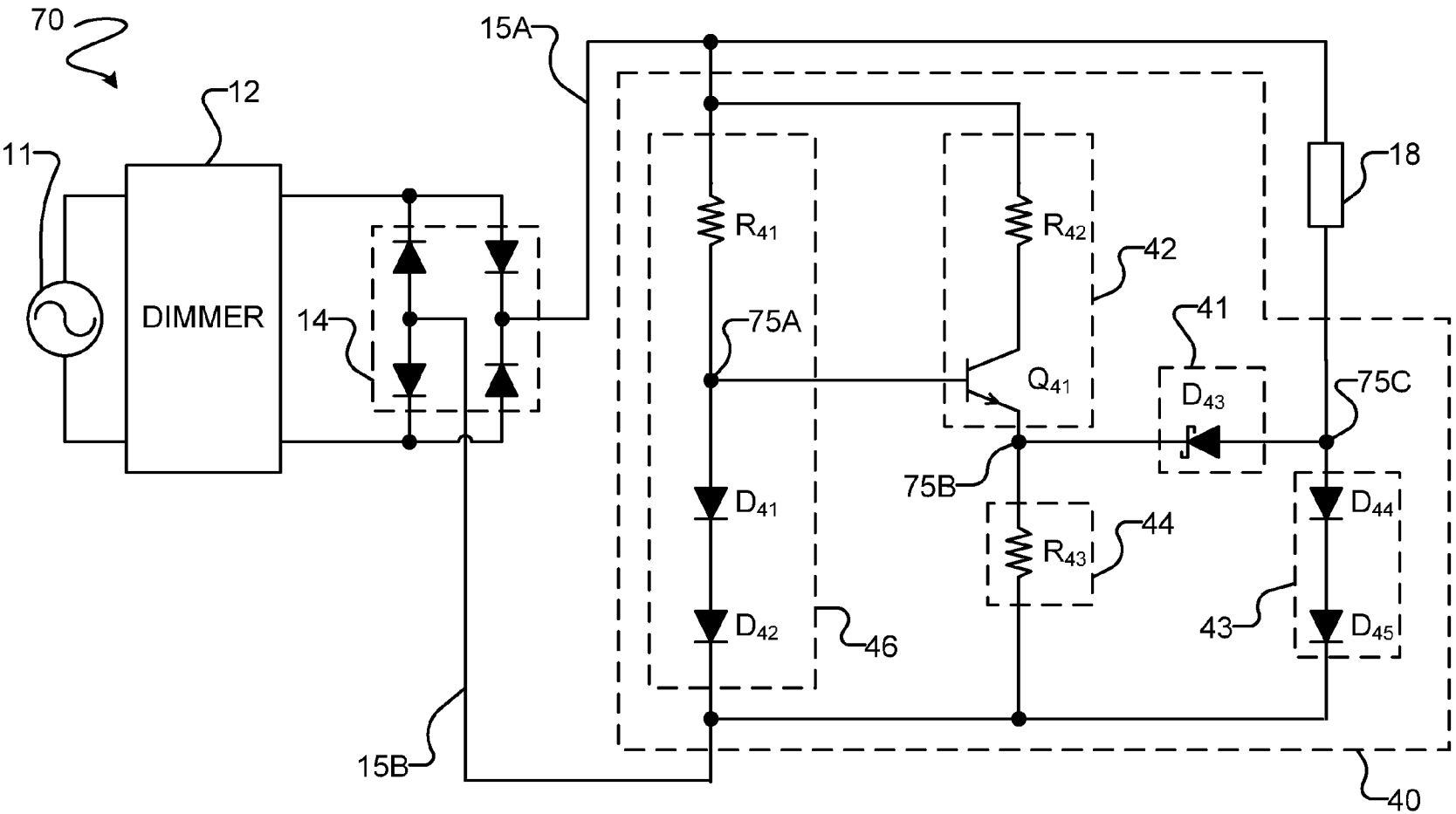
FIG. 3 is a schematic of an electrical circuit comprising a holding current circuit according to an example embodiment.

FIG. 3 is a schematic of an electrical circuit 70. Circuit 70 comprises an example implementation of holding current circuit 40 of FIG. 2. Circuit 70 has a number of elements in common with circuit 40 of FIG. 2, which elements are labeled with the same reference numerals and will not be described in detail again. Borders in broken line are drawn to surround components in circuit 70 and numbered to illustrate the correspondence with elements of holding current circuit 40. The specific components in circuit 70 are examples of components that could be used in holding current circuits of the general configuration of holding current circuit 40. It will be appreciated that the operation of circuit 70, and other embodiments comprising circuits of the general configuration of holding current circuit 40 may not exactly match the manner of operation described above due to non-ideal behaviours of physical components (e.g., turn-on voltages of transistors, and the like).

In circuit 70, a series connection of a resistor $R_{41}$ and series-connected diodes $D_{41}$ and $D_{42}$ provides a conduction dependent reference voltage at node 75A. One end of resistor $R_{41}$ is connected to voltage supply rail 15A; the other end of resistor $R_{41}$ is connected to the anode of diode $D_{41}$. The cathode of diode $D_{42}$ is connected to return rail 15B. When diodes $D_{41}$ and $D_{42}$ are conducting (e.g., when the voltage on supply rail 15A is greater than the sum of the forward voltages of diodes $D_{41}$ and $D_{42}$), resistor $R_{41}$ establishes a bias current through diodes $D_{41}$ and $D_{42}$, and diodes $D_{41}$ and $D_{42}$ establish a substantially stable reference voltage at node 75A. When diodes $D_{41}$ and $D_{42}$ are not conducting (e.g., when the voltage on supply rail 15A is less than the sum of the forward voltages of diodes $D_{41}$ and $D_{42}$) the voltage at node 75A is essentially the same as the voltage at supply rail 15A. It will be appreciated that diodes $D_{41}$ and $D_{42}$ may be selected so that the sum of their forward voltages is relatively small compared to the range of voltage on supply rail 15A. Where diodes $D_{41}$ and $D_{42}$ are so selected, the reference voltage provided at node 75A will, in the case of leading-edge phase-cut dimming, switch between the voltage on supply rail 15A and the sum of the forward voltages of diodes $D_{41}$ and $D_{42}$ at the conduction angle of dimmer 12 for a wide range of conduction angles. For example, if AC source 11 is configured to provide an AC voltage having a peak voltage of 170 volts and the sum of the forward voltages of diodes $D_{41}$ and $D_{42}$ is 1.4 volts, the reference voltage provided at node 75A will, in the case of leading-edge phase-cut dimming, switch from the voltage on supply rail 15A to 1.4 volts at any conduction angle between 0.472 degrees and 179.528 degrees.

In other embodiments, a conduction dependent voltage reference may be implemented using different combinations and/or arrangements of components, including diodes, bipolar junction transistors, field effect transistors (FETs), Schottky diodes, Zener diodes and the like. The combination and/or arrangement of components may be selected to provide a desired stable reference voltage during the portion of the power cycle that dimmer 12 is 'on' using analytical techniques known in the art. In some embodiments the stable voltage provided by a conduction dependent voltage reference may be manually adjustable or programmable to deliver a desired stable reference voltage.

In circuit 70, an npn-type bipolar junction transistor $Q_{41}$ acts as a controlled current source that draws supplemental current from dimmer 12 when diodes $D_{41}$ and $D_{42}$ are conducting and the current in load 18 is below a threshold. A resistor $R_{42}$ is optionally connected between supply rail 15A and the collector of transistor $Q_{41}$. In some embodiments, the collector of transistor $Q_{41}$ is connected directly to supply rail 15A. The base of transistor $Q_{41}$ is connected to receive the reference voltage at node 75A. The emitter of transistor $Q_{41}$ is connected to node 75B.

A Schottky diode $D_{43}$ is connected between the ground output of load 18 (node 75C) and node 75B. The anode of Schottky diode $D_{43}$ is connected to node 75C; the cathode of Schottky diode $D_{43}$ is connected to node 75B. A resistor $R_{43}$ is connected between node 75B and return rail 15B. Resistor $R_{43}$ converts the current through it into a voltage across it, which appears at node 75B, according to Ohm's law. Series connected diodes $D_{44}$ and $D_{45}$ are connected between node 75C and return rail 15B. The anode of diode $D_{44}$ is connected to node 75C. The cathode of diode $D_{45}$ is connected to return rail 15B. Series connected diodes $D_{44}$ and $D_{45}$ providing a path for excess current to bypass resistor $R_{43}$.

The collector current in transistor $Q_{41}$ is controlled by the voltage difference between nodes 75A and 75B (i.e., the base-emitter voltage of transistor $Q_{41}$). The voltage at node 75B (i.e., the voltage at the emitter of transistor $Q_{41}$) is determined by the current through resistor $R_{43}$. When series-connected diodes $D_{41}$ and $D_{42}$ are conducting, diodes $D_{41}$ and $D_{42}$ establish a substantially stable voltage at node 75A (i.e., at the base of transistor $Q_{41}$). Consequently, when series-connected diodes $D_{41}$ and $D_{42}$ are conducting, the collector current in transistor $Q_{41}$ depends primarily on the voltage at node 75B. Because the collector current in transistor $Q_{41}$ is positively related to the voltage difference between nodes 75A and 75B when transistor $Q_{41}$ is in active mode (e.g., when the voltage at node 75A is greater than the voltage at node 75B by at least the turn-on voltage of $Q_{41}$, but not sufficiently large to cause transistor $Q_{41}$ to saturate), the collector current in transistor $Q_{41}$ is negatively related to the current in resistor $R_{43}$ when transistor $Q_{41}$ is in active mode.

When Schottky diode $D_{43}$ is conducting and current bypass diodes $D_{44}$ and $D_{45}$ are not, the current in resistor $R_{43}$ is the sum of the currents in the emitter of transistor $Q_{41}$ and load 18. Resistor $R_{43}$ may be configured so that for currents in load 18 less than a threshold (e.g., the holding current of dimmer 12), the voltage across $R_{43}$ attributable to the current in load 18 is sufficiently less than the reference voltage established by series-connected diodes $D_{41}$ and $D_{42}$ such that transistor $Q_{41}$ conducts current from its collector to its emitter. In embodiments where resistor $R_{43}$ is so configured, $Q_{41}$ will draw current through dimmer 12 when it is necessary to supplement the current drawn by load 18 to maintain a holding current through dimmer 12.

Resistor $R_{43}$ may be selected so that for currents in load 18 greater than a threshold (e.g., the holding current of dimmer 12), the voltage across $R_{43}$ attributable to the current in load 18 is sufficiently large that the difference between the voltage at the emitter of transistor $Q_{41}$ (node 75B) and the reference voltage established by series-connected diodes $D_{41}$ and $D_{42}$ (at node 75A) is insufficient to cause transistor $Q_{41}$ to conduct current from its collector to its emitter. In embodiments where resistor $R_{43}$ is so configured, $Q_{41}$ will not draw current when the current drawn by load 18 is sufficient to maintain at least the holding current through dimmer 12. In some embodiments, $R_{43}$ is configured so that when the current in $R_{43}$ is equal to the holding current, the voltage across $R_{43}$ is equal to the reference voltage established by series-connected diodes $D_{41}$ and $D_{42}$ less the turn-on voltage of transistor $Q_{41}$.

It will be appreciated that the configuration of circuit 70 provides negative feedback control on the collector current of transistor $Q_{41}$ when dimmer 12 is in conduction. In operation, when the current through load 18 is sufficiently small to cause a current in resistor $R_{43}$ that results in a voltage at node 75B sufficiently less than the voltage at node 75A, transistor $Q_{41}$ draws current from voltage supply rail 15A to supply additional current to resistor $R_{43}$. The current added by transistor $Q_{41}$ to the current in resistor $R_{43}$ causes the voltage at node 75B to increase, which reduces the voltage difference between nodes 75A and 75B, throttling the collector current of transistor $Q_{41}$. Thus the series connection of the emitter of transistor $Q_{41}$ and resistor $R_{43}$ and the dependance of the collector current of transistor $Q_{41}$ on the voltage across resistor $R_{43}$ constitutes a negative feedback loop, which stabilizes the collector current of transistor $Q_{41}$.

When dimmer 12 is not in conduction (e.g., during the 'off' portion of a phase-cut voltage half-wave), the voltage at supply rail 15A and return rail 15B will be approximately the same. As a result, the voltage at node 75A cannot be greater than the voltage at node 75B to cause transistor $Q_{41}$ to conduct, and holding current circuit 40 does not draw current from supply rail 15A.

In some embodiments, different combinations and/or arrangements of components may be used to provide a current-to-voltage converter. For example, a thermistor and/or a network of resistors may be used in place of resistor $R_{43}$. A current-to-voltage converter may comprise active components (e.g., operational amplifiers). The combination and/or arrangement of components may be selected to provide a desired current to voltage conversion relationship using analytical techniques known in the art.

In some embodiments, different combinations and/or arrangements of components may be used to provide a controlled current source. For example, components such as FETs, MOSFETs, HEXFETs, Darlington transistors and the like may be used, alone or in combination, in place of, or in addition to, npn-type bipolar junction transistor $Q_{41}$. The combination and/or arrangement of components may be selected to provide a desired current gain in relation to a target current or voltage using analytical techniques known in the art.

Resistor $R_{43}$, Schottky diode $D_{43}$, and series-connected diodes $D_{44}$ and $D_{45}$ may be configured so that when the current in load 18 is greater than an excess current threshold (e.g., a threshold greater than the threshold current above which $Q_{41}$ does not conduct current), the sum of the voltages across resistor $R_{43}$ and Schottky diode $D_{43}$ is equal to the sum of the built-in potentials (also known in the art as "turn-on voltages" or "on-voltages" or "diode forward voltage drops") of series-connected diodes $D_{44}$ and $D_{45}$. In such embodiments, currents in load 18 above the excess current threshold will cause the voltage at node 75C to be above the sum of the built-in potentials of series-connected diodes $D_{44}$ and $D_{45}$, which will cause series-connected diodes $D_{44}$ and $D_{45}$ to conduct. When series-connected diodes $D_{44}$ and $D_{45}$ conduct, current is shunted away from resistor $R_{43}$ and the voltage at node 75C is limited to the sum of the built-in potentials of series-connected diodes $D_{44}$ and $D_{45}$.

In some embodiments, the sum of the built-in potentials of series-connected diodes $D_{44}$ and $D_{45}$ is the same as the sum of the built-in potentials of series-connected diodes $D_{41}$ and $D_{42}$. In such embodiments, when series-connected diodes $D_{44}$ and $D_{45}$ are conducting current from the load, the voltage at node 75C will be approximately the same as the voltage at the base of transistor $Q_{41}$, and the base-emitter voltage of transistor $Q_{41}$ will be approximately equal to the voltage across Schottky diode $D_{43}$. Where the built-in potential of Schottky diode $D_{43}$ is less than the turn-on voltage of transistor $Q_{41}$ (e.g., 0.5 volts versus 0.7 volts), the base-emitter voltage of transistor $Q_{41}$ will be insufficient to cause transistor $Q_{41}$ to conduct under these conditions.

In other embodiments, different combinations and/or arrangements of components may be used to provide an excess current bypass. For example, any suitable type of diode or diode-connected transistor may be used in an excess current bypass. The combination and/or arrangement of components used to provide an excess current bypass may be selected to provide desired excess current threshold using analytical techniques known in the art.

In a particular example embodiment of a holding current circuit according to holding current circuit 40, resistor $R_{41}$ comprises a resistor having resistance of 40 KΩ, resistor $R_{43}$ comprises a resistor having resistance of 22Ω, and $R_{42}$ comprises a resistor having a resistance of 22Ω. It will be appreciated that these example components specifications may be modified to tune the operation of holding current circuit 40, and that holding current circuit 40 may work with different component specifications.

Figure 4A:
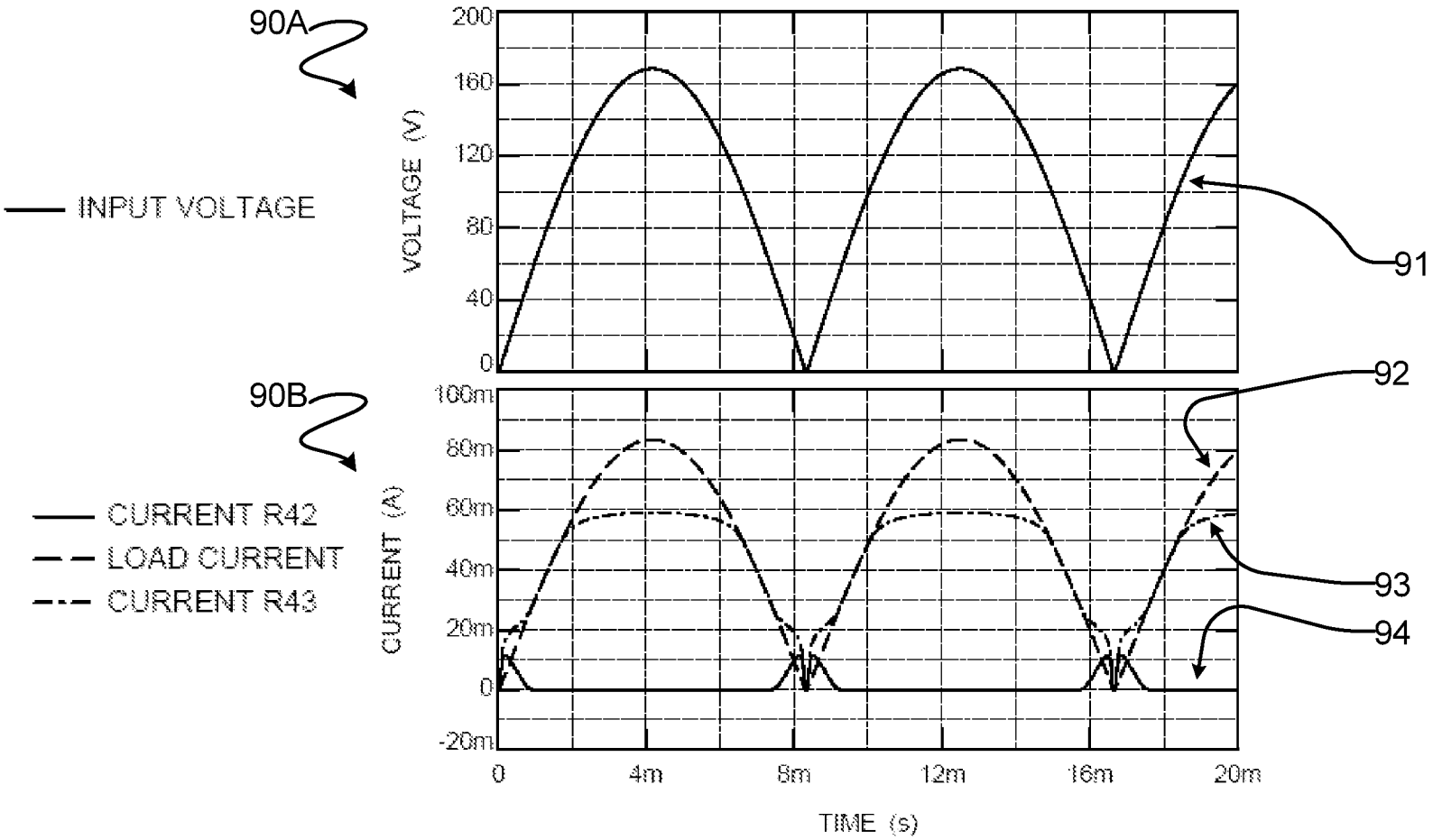
FIG. 4A is a graph showing modeled current and voltage in the holding current circuit depicted in FIG. 3.
Figure 4B:
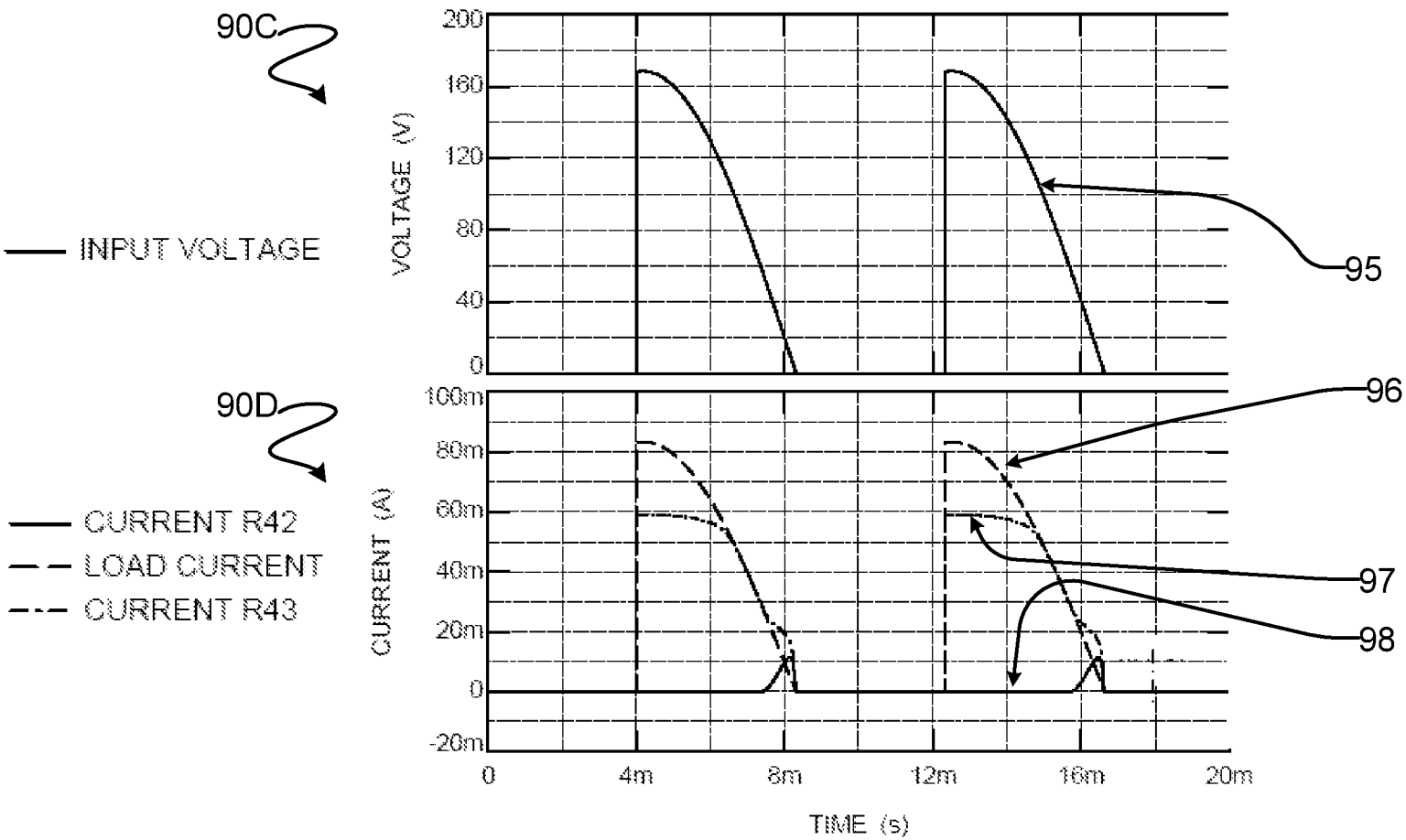
FIG. 4B is a graph showing modeled current and voltage in the holding current circuit depicted in FIG. 3.

FIGS. 4A and 4B show graphs of modeled time-varying voltages and currents in an example electrical circuit like circuit 70. Graph 90A shows a waveform 91 representing full-wave, rectified AC voltage on voltage supply rail 15A. Waveform 91 represents an AC voltage having a root mean square voltage of approximately 120 volts and a frequency of 60 Hertz. Graph 90B shows three current waveforms. Waveform 92 represents the current in load 18. Waveform 93 represents the current in resistor $R_{43}$. Waveform 94 represents the current in resistor $R_{42}$.

Graph 90C shows a waveform 95 representing leading-edge phase-cut rectified AC voltage on voltage supply rail 15A. Waveform 95 represents a leading-edge phase-cut AC voltage derived from an input AC voltage having a root mean square voltage of approximately 120 volts and a frequency of 60 Hertz. Graph 90D shows three current waveforms. Waveform 96 represents the current in load 18. Waveform 97 represents the current in resistor $R_{43}$. Waveform 98 represents the current in resistor $R_{42}$.

It can be seen from graphs 90B and 90D that the peaks of currents 92 and 96 in load 18 are higher than the peaks of currents 93 and 97 in resistor $R_{43}$, which shows that current in load 18 above an excess current threshold is shunted away from resistor $R_{43}$. Between the excess current threshold and a holding current threshold, all of currents 92 and 96 in load 18 flow into $R_{43}$ as currents 93 and 97, respectively. As load currents 92 and 96 fall below the holding current threshold, currents 94 and 98 in resistor $R_{42}$ (i.e., in the collector of transistor $Q_{41}$) increase to supplement load currents 92 and 96, respectively, to maintain holding currents in resistor $R_{43}$. Conversely, when load current 92 rises from zero to the holding current threshold level, current in $R_{42}$ decreases. As can be seen in graphs 90C and 90D, current 98 in resistor $R_{42}$ is zero during the 'off' portion of a phase-cut voltage half-wave. It will be appreciated that the zero points of input voltage waveform 91 correspond to zero-crossings of the AC voltage provided by AC source 11, at which points dimmer 12 might be re-triggered.

Figure 5A:
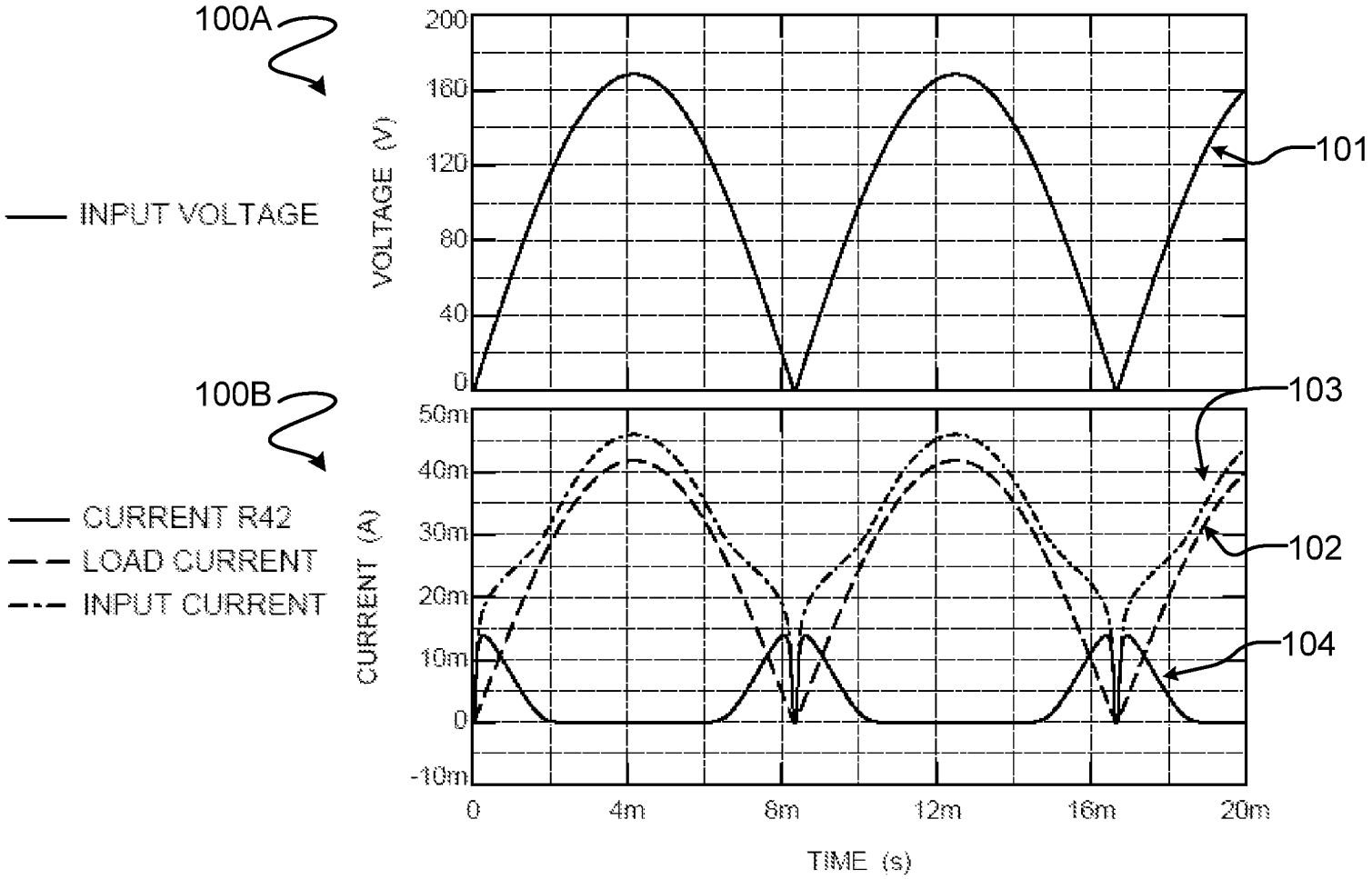
FIG. 5A is a graph showing modeled current and voltage in the holding current circuit depicted in FIG. 3.
Figure 5B:
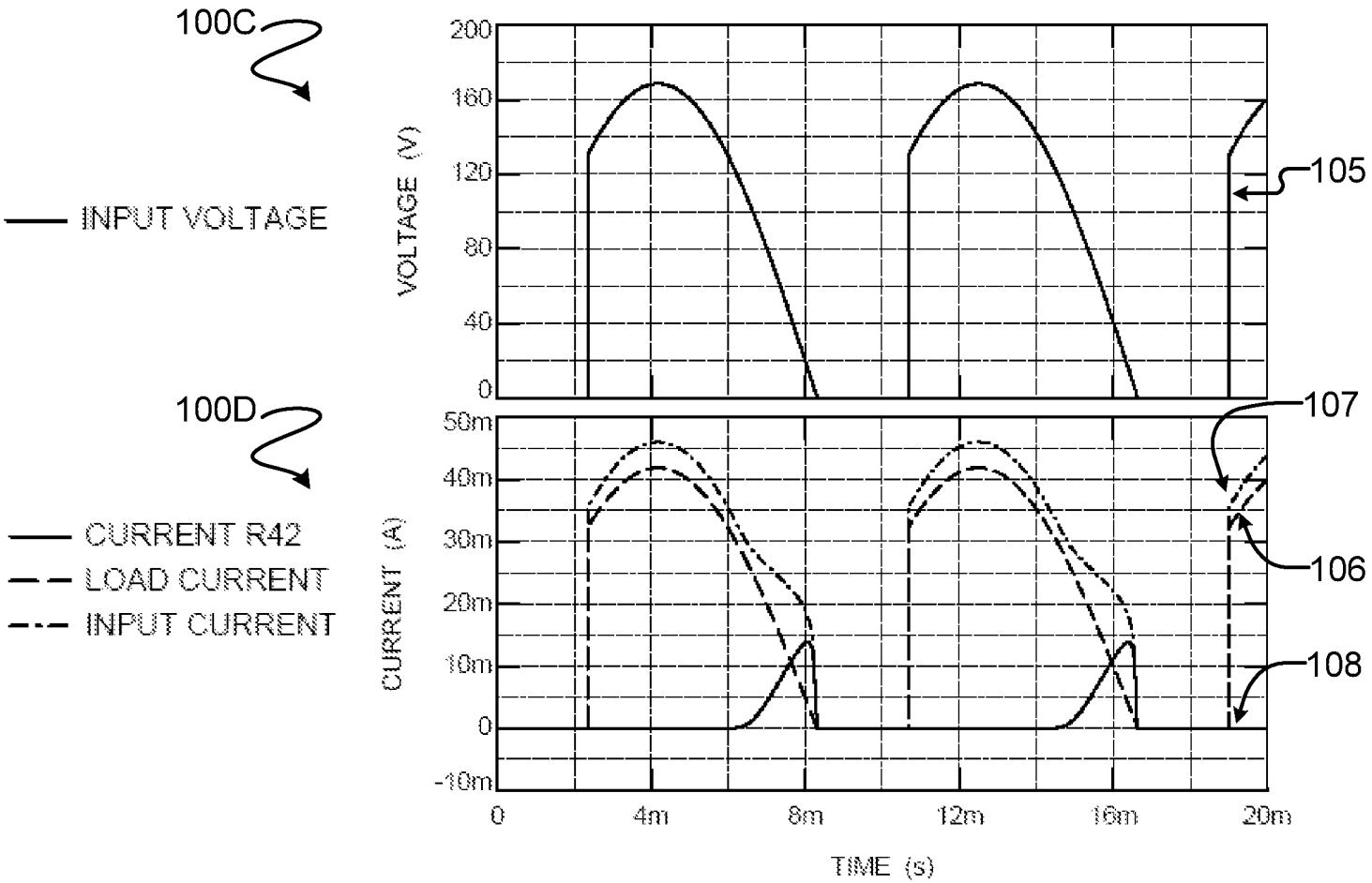
FIG. 5B is a graph showing modeled current and voltage in the holding current circuit depicted in FIG. 3.

FIGS. 5A and 5B show graphs of modeled time-varying voltages and currents in an electrical circuit like circuit 70. In comparison with the circuit which provided the waveforms in FIGS. 4A and 4B, the load of the circuit which provided the waveforms in FIGS. 5A and 5B has a higher impedance. Graph 100A shows a waveform 101 representing full-wave, rectified AC voltage on voltage supply rail 15A. Waveform 101 represents an AC voltage having a root mean square voltage of approximately 120 volts and a frequency of 60 Hertz. Graph 100B shows three current waveforms. Waveform 102 represents the current in load 18. Waveform 103 represents the input current supplied via voltage supply rail 15A. Waveform 104 represents the current in resistor $R_{42}$.

Graph 100C shows a waveform 105 representing a leading-edge phase-cut rectified AC voltage on voltage supply rail 15A. Waveform 105 represents a leading-edge phase-cut AC voltage derived from an input AC voltage having a root mean square voltage of approximately 120 volts and a frequency of 60 Hertz. Graph 100D shows three current waveforms. Waveform 106 represents the current in load 18. Waveform 107 represents the input current supplied via voltage supply rail 15A. Waveform 108 represents the current in resistor $R_{42}$.

It can be seen from graphs 100B and 100D that for load currents 102 and 106 above a holding current threshold, input currents 103 and 107 are slightly larger than and track load currents 102 and 106, respectively. As load currents 102 and 106 fall below the holding current threshold, current in $R_{42}$ increases to maintain input currents 103 and 107 above the holding current threshold, at least until the input voltage nears zero. Conversely, when load current 102 rises from zero to the holding current threshold, current in resistor $R_{42}$ decreases. As can be seen in graphs 100C and 100D, current 108 in resistor $R_{42}$ is zero during the 'off' portion of a phase-cut voltage half-wave.

Figure 6:
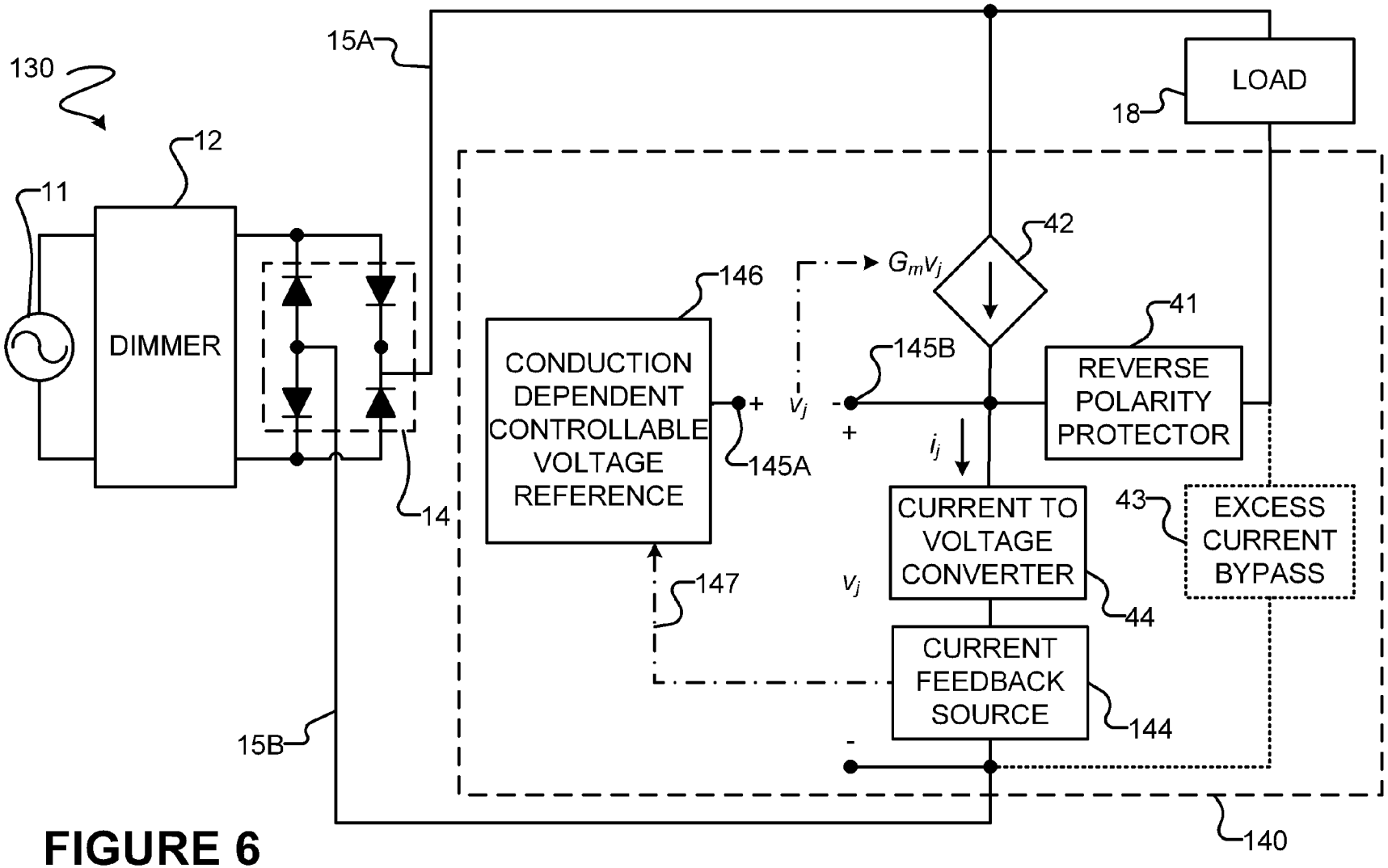
FIG. 6 is a block diagram of an electrical circuit comprising a holding current circuit according to an example embodiment.

FIG. 6 is a block diagram of an electrical circuit 130 comprising a holding current circuit 140 according to an example embodiment. Circuit 140 has a number of elements in common with circuit 40 of FIG. 2, which elements are labeled with the same reference numerals and will not be described in detail again. Holding current circuit 140 is connected between voltage supply rail 15A and return rail 15B.

Holding current circuit 140 comprises a conduction dependent controllable voltage reference 146. Conduction dependent controllable voltage reference 146 may be configured to detect information about the conduction state of dimmer 12 based on voltage and/or current passed by dimmer 12. For example, conduction dependent voltage reference 146 may be connected to voltage supply rail 15A. In some embodiments, conduction dependent voltage reference 146 is connected between voltage supply rail 15A and return rail 15B. An output of conduction dependent controllable voltage reference 146 provides a first reference voltage at node 145A when dimmer 12 is not in conduction and a second controllable reference voltage at node 145A when dimmer 12 is in conduction. Holding current circuit 140 may be configured to switch between the first and second reference voltage regimes at the conduction angle of dimmer 12, ahead of the conduction angle of dimmer 12 or after the conduction angle of dimmer 12.

The controllable voltage that conduction dependent controllable voltage reference 146 provides at its output when dimmer 12 is in conduction is controlled by a feedback control signal 147 from a current feedback source 144. Feedback control signal 147 and conduction dependent controllable voltage reference 146 are configured so that the output voltage provided by reference 146 relative to return rail 15B is negatively related to the current $i_j$ in current feedback source 144.

Current-to-voltage converter 44 is series connected with current feedback source 144 between node 145B and return rail 15B. Current-to-voltage converter 44 converts the current through it into a voltage across it, which together with the voltage (if any) across current feedback source 144 makes up voltage difference between node 145B and return rail 15B. Controlled current source 42 is controlled by the voltage difference $v_j$ between nodes 145A and 145B. In particular, the current in controlled current source 42 is related by gain factor $G_m$ to the difference $v_j$ between the voltage at node 145A and the voltage at node 145B. An arrow drawn in stippled line shows the dependence relationship of the current $G_m v_j$ in controlled current source 42 on the voltage difference $v_j$ between nodes 145A and 145B.

When reverse polarity protector 41 is conducting, the current $i_j$ in current-to-voltage converter 44 and current feedback source 144 is equal to the sum of the currents in controlled current source 42 and load 18. The combined current $i_j$ controls both the voltage at node 145A, which depends on the current in current feedback source 144 via voltage reference 146, and the voltage at node 145B, which is established by current-to-voltage converter 44. Since the voltage difference between node 145A and 145B controls voltage controlled current source 42, the sum of the currents in load 18 and voltage controlled current source 42 controls the current in voltage controlled current source 42.

It will be appreciated the configuration of holding current circuit 140 provides negative feedback control on the current in controlled current source 42. As controlled current source 42 draws more current or as more current passes through load 18, the voltage developed across current-to-voltage converter 44 and the current in current feedback source 144 increase. The increase in voltage across current-to-voltage converter 44 is reflected in a higher voltage at node 145B. The increase in current in current feedback source 144 causes conduction dependent controllable voltage reference 146 to lower the voltage at node 145A. Since the difference between the voltages at nodes 145A and 145B controls the current in controlled current source 42, increasing the voltage at node 145B while decreasing the voltage at node 145A throttles the current in controlled current source 42.

When the current through load 18 is sufficiently large, the current in current-to-voltage converter 44 will result in a voltage at node 145B greater than the voltage established by conduction dependent controllable voltage reference 146 at node 145A, under which condition controlled current source 42 draws no current from dimmer 12. In some embodiments, current-to-voltage converter 44, conduction dependent controllable voltage reference 146, current feedback source 144 and controlled current source 42 are configured so that controlled current source 42 does not draw current from dimmer 12 when the current through current-to-voltage converter 44 and current feedback source 144 is at least a holding current.

When the current through load 18 is sufficiently small, the current in current-to-voltage converter 44 will result in a voltage at node 145B less than the voltage established by conduction dependent controllable voltage reference 146 at node 145A, under which condition controlled current source 42 draws additional current from dimmer 12 (e.g., via supply rail 15A) to supplement the load current in current-to-voltage converter 44. In some embodiments, current-to-voltage converter 44, conduction dependent controllable voltage reference 146, current feedback source 144 and controlled current source 42 are configured so that controlled current source 42 draws current from dimmer 12 when dimmer 12 is in conduction and the current in current-to-voltage converter 44 and current feedback source 144 is less than a holding current.

Controlled current source 42, current-to-voltage converter 44, current feedback source 144 and conduction dependent voltage reference 146 may be configured so that controlled current source 42 selectively passes current to maintain a pre-determined equilibrium current level in current-to-voltage converter 44 for at least part of the portion of the power-cycle in which dimmer 12 is in conduction. In some embodiments, current-to-voltage converter 44, current feedback source 144 and conduction dependent voltage reference 146 are configured such that controlled current source 42 does not pass current when dimmer 12 is 'off', and passes current when dimmer 12 is 'on' when current in load 18 is less than a holding current required to maintain dimmer 12 in conduction. For example, conduction dependent voltage controllable reference 146 may be configured to provide a first reference voltage at node 145A when dimmer 12 is not in conduction that is lower than the lowest voltage in a range of voltages that it may provide at node 145A when dimmer 12 is in conduction. In some embodiments, conduction dependent controllable voltage reference 146 and current-to-voltage converter 44 are configured so that the voltages at nodes 145A and 145B result in no current in controlled current source 42 when the current in current-to-voltage converter 44 is equal to the holding current.

Figure 7:
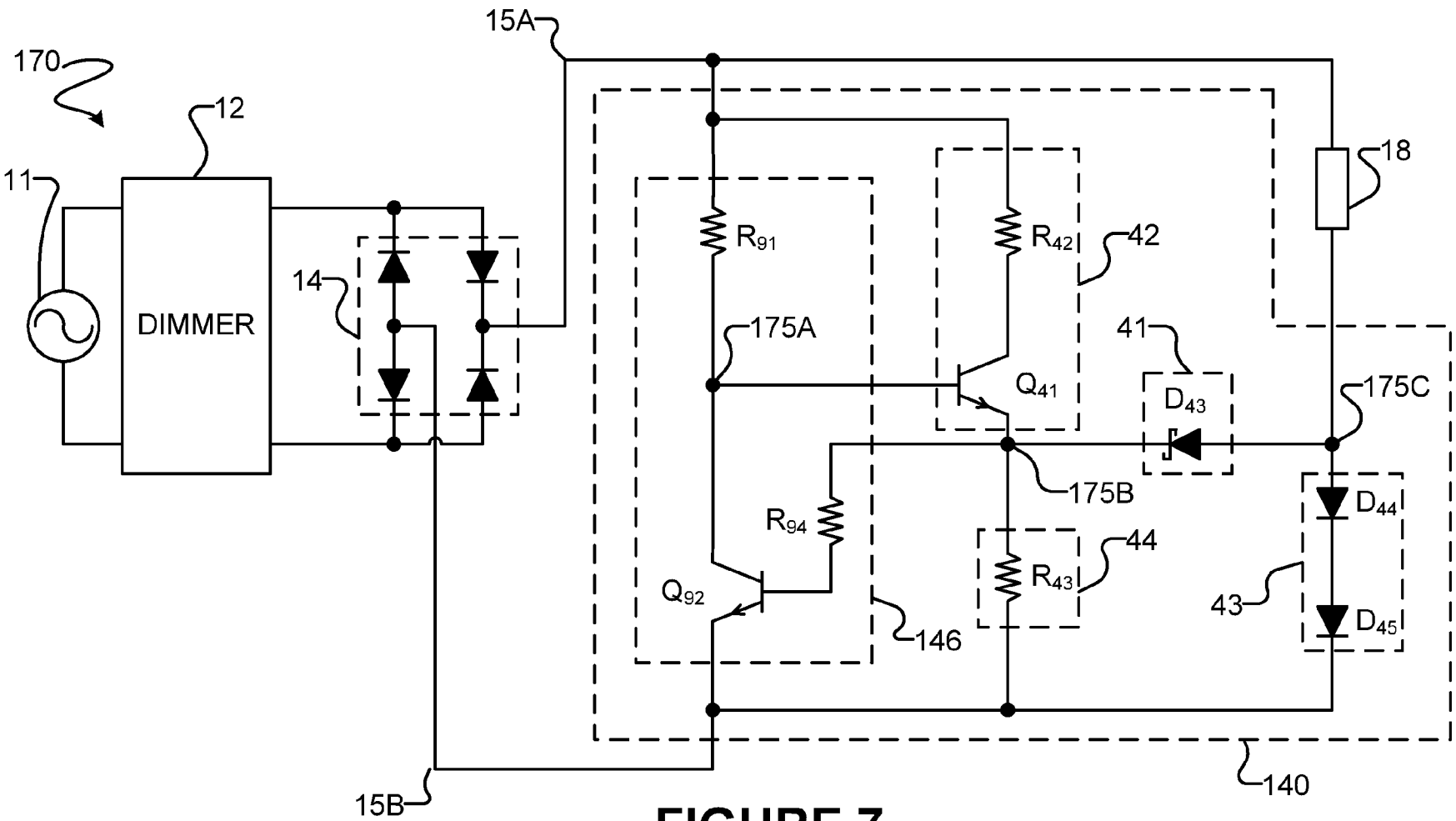
FIG. 7 is a schematic of an electrical circuit comprising a holding current circuit according to an example embodiment.
Figure 8A:
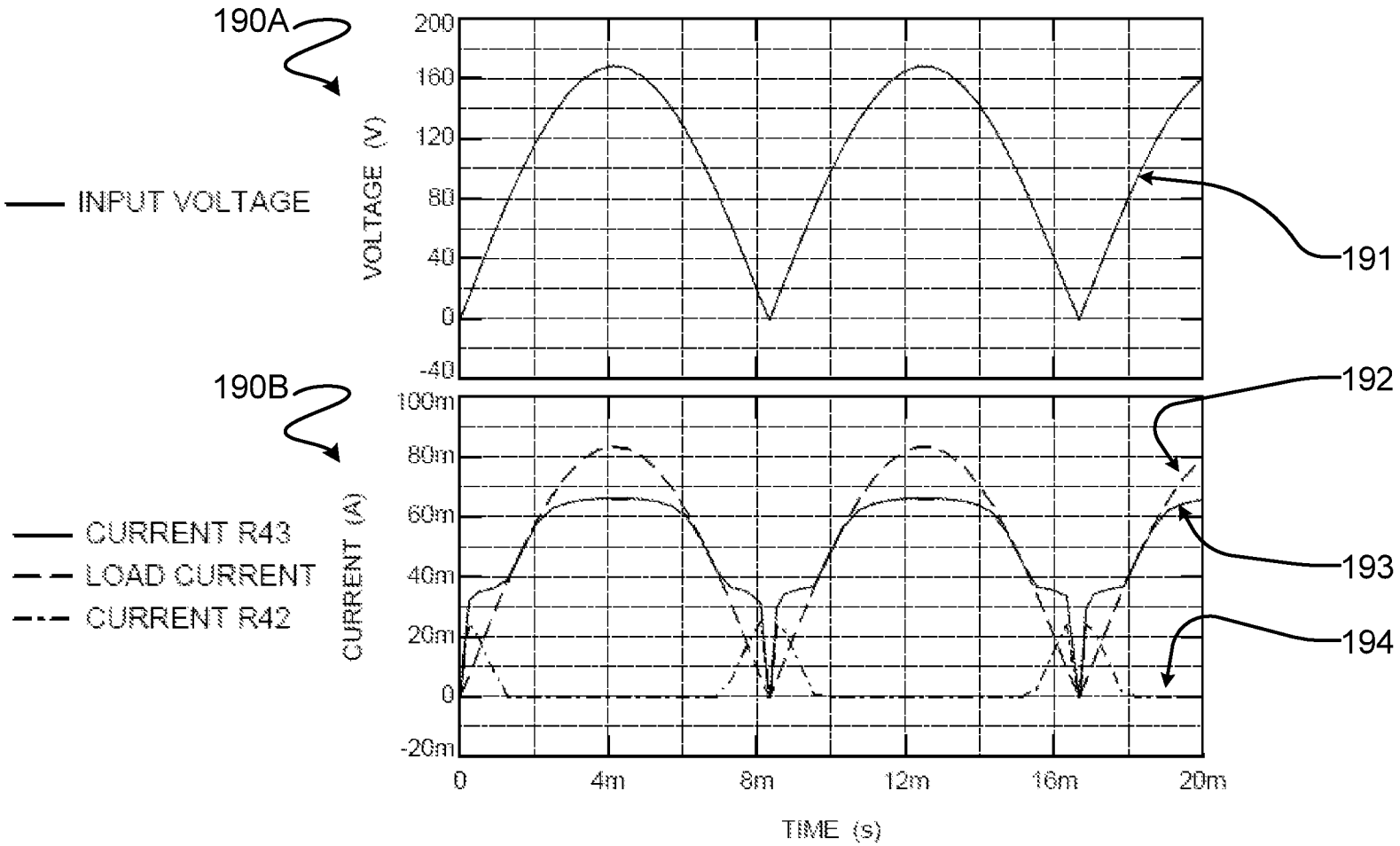
FIG. 8A is a graph showing modeled current and voltage in the holding current circuit depicted in FIG. 7.
Figure 8B:
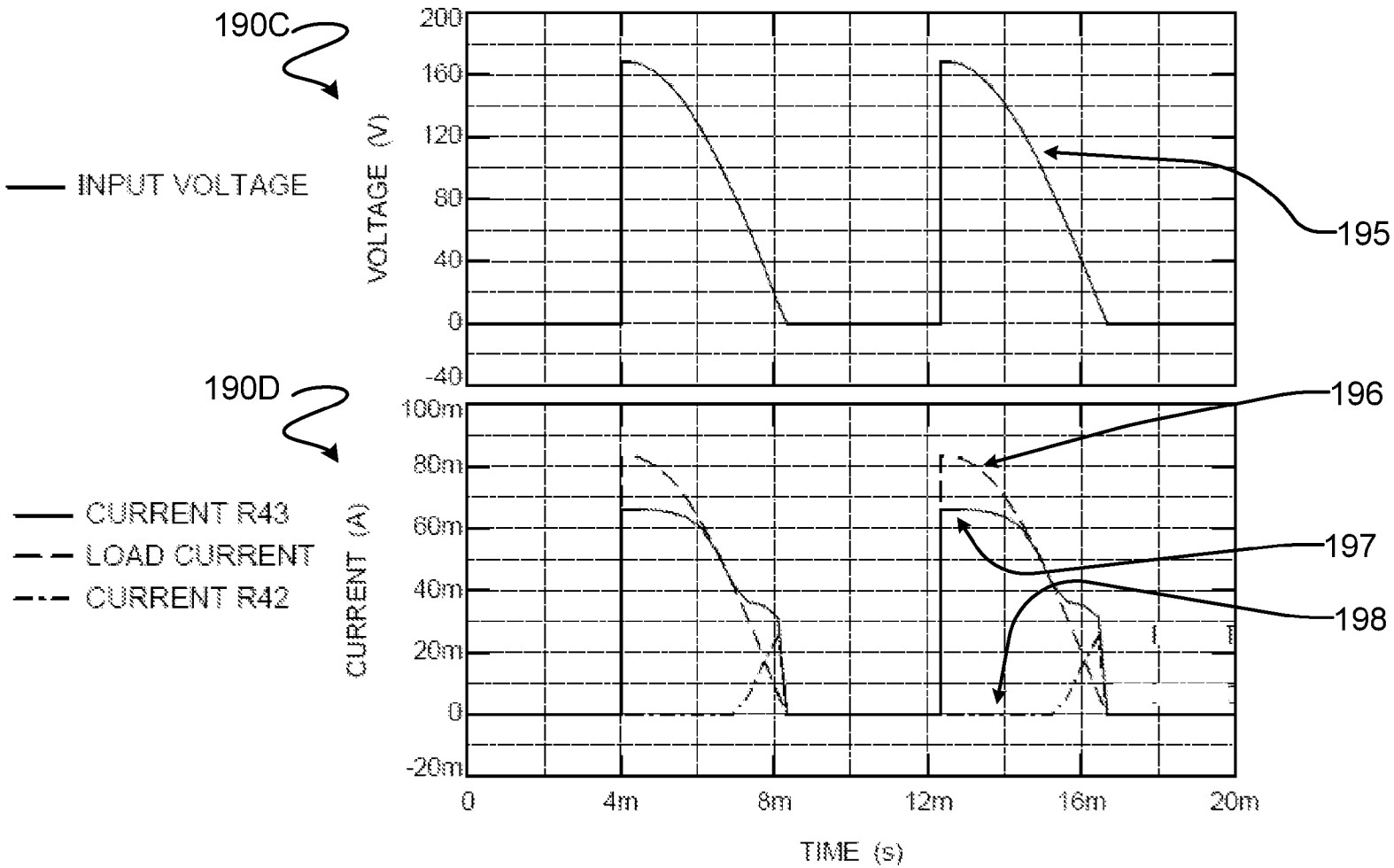
FIG. 8B is a graph showing modeled current and voltage in the holding current circuit depicted in FIG. 7.
Figure 9A:
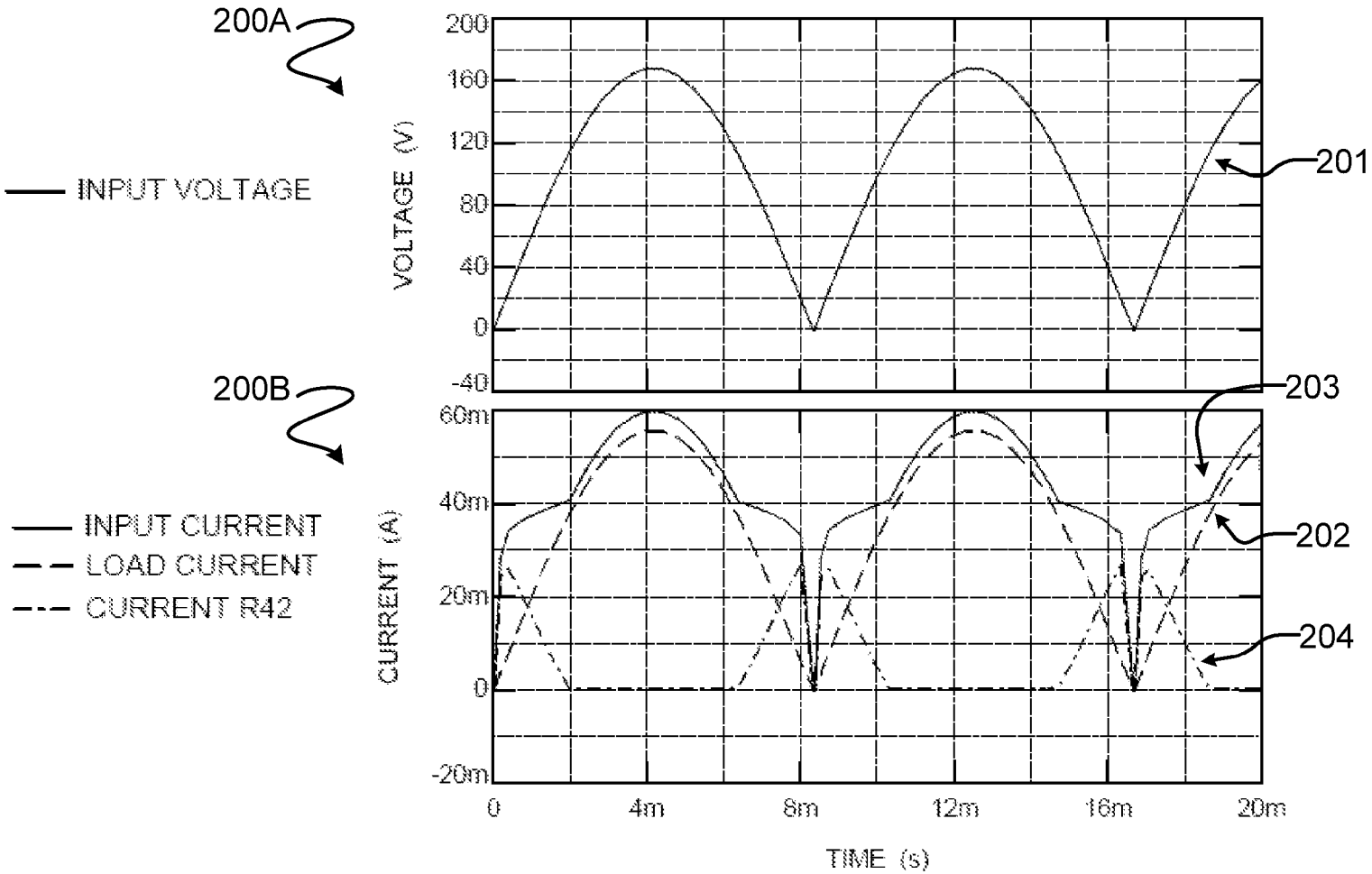
FIG. 9A is a graph showing modeled current and voltage in the holding current circuit depicted in FIG. 7.
Figure 9B:
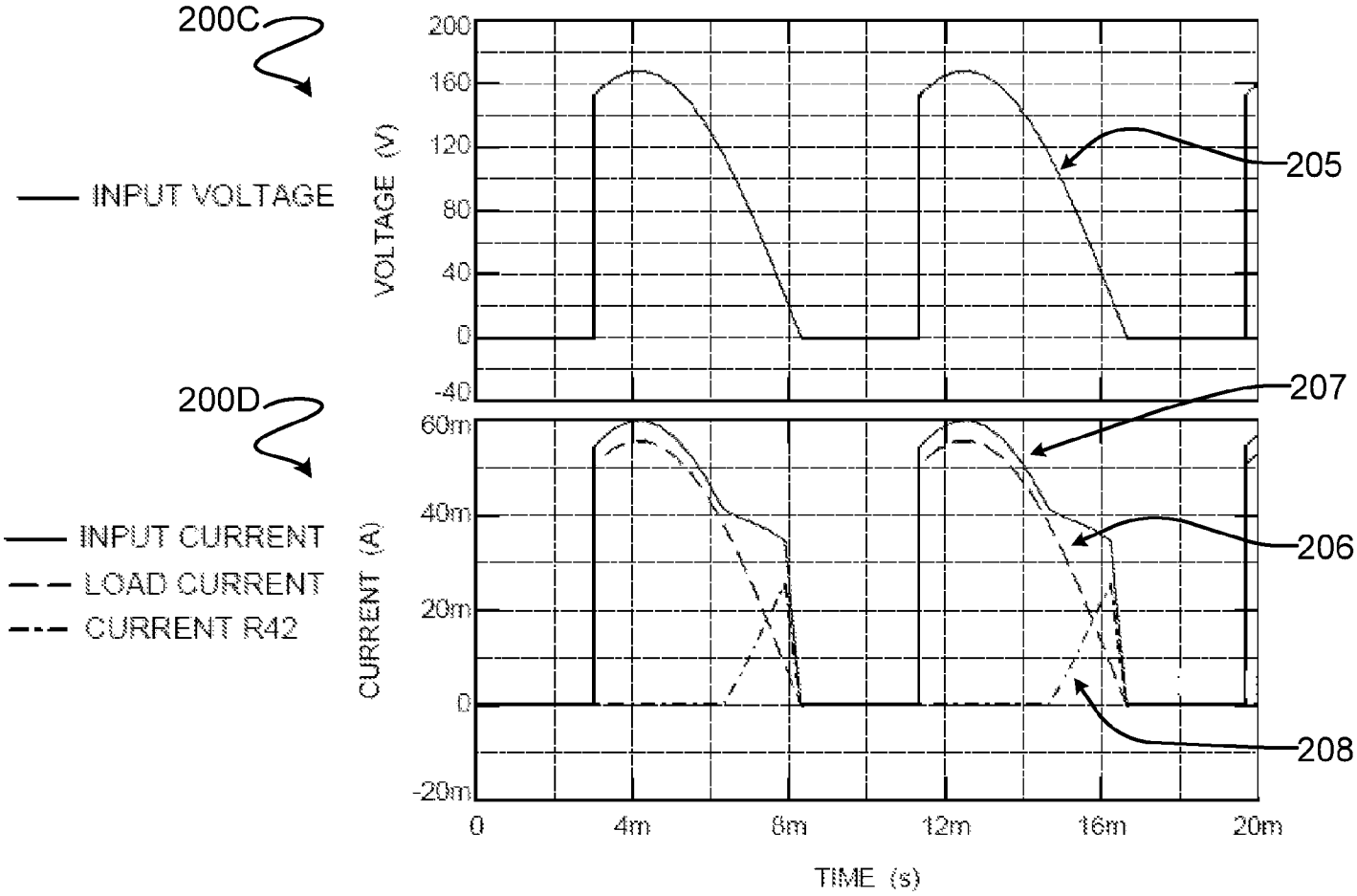
FIG. 9B is a graph showing modeled current and voltage in the holding current circuit depicted in FIG. 7.

FIG. 7 is a schematic of an electrical circuit 170. Circuit 170 comprises an example implementation of holding current circuit 140 of FIG. 6. Circuit 170 has a number of elements in common with holding current circuit 140 of FIG. 6, which elements are labeled with the same reference numerals and will not be described in detail again. Borders in broken line are drawn to surround components in circuit 170 and numbered to illustrate the correspondence with elements of holding current circuit 140. The specific components in circuit 170 are examples of the components that could be used in holding current circuits of the general configuration of holding current circuit 140. It will be appreciated that the operation of circuit 170, and other embodiments comprising circuits of the general configuration of holding current circuit 140 may not exactly match the manner of operation described above due to non-ideal behaviours of physical components (e.g., turn-on voltages of transistors, and the like).

In circuit 170, an npn-type bipolar junction transistor $Q_{92}$ provides a conduction dependent controllable reference voltage at its collector (node 175A). Transistor $Q_{92}$ is connected at its collector to a resistor $R_{91}$ and connected at its base to a resistor $R_{94}$. The end of resistor $R_{91}$ not connected to transistor $Q_{92}$ is connected to voltage supply rail 15A. The end of resistor $R_{94}$ not connected to transistor $Q_{92}$ is connected to node 175B. The emitter of transistor $Q_{92}$ is connected to return rail 15B.

When transistor $Q_{92}$ is active (e.g., when the voltage difference between the base and the emitter of transistor $Q_{92}$ is greater than the turn-on voltage of transistor $Q_{92}$), transistor $Q_{92}$ establishes a reference voltage at 175A equal to the collector-emitter voltage of transistor $Q_{92}$. When transistor $Q_{92}$ is inactive (e.g., when the voltage at supply rail 15A is less than the turn-on voltage of transistor $Q_{92}$), the voltage at node 175A is essentially the same as the voltage at supply rail 15A. It will be appreciated that transistor $Q_{92}$ may be selected so that its turn-on voltage is relatively small compared to the range of voltage on supply rail 15A. Where transistor $Q_{92}$ is so selected, the reference voltage provided at node 175A will, in the case of leading-edge phase-cut dimming, switch between the voltage on supply rail 15A and the emitter-collector voltage of $Q_{92}$ at the conduction angle of dimmer 12 for a wide range of conduction angles.

The current in the collector of transistor $Q_{41}$ is controlled by the voltage difference between nodes 175A and 175B (i.e., the base-emitter voltage of transistor $Q_{41}$). The voltage at node 175A (i.e., the voltage at the base of transistor $Q_{41}$) is established by the collector-emitter voltage of transistor $Q_{92}$, which follows the voltage at the base of transistor $Q_{92}$. Since there is negligible voltage drop across resistor $R_{94}$, the voltage at the base of transistor $Q_{92}$ approximates the voltage at node 175B (i.e., the voltage at the emitter of transistor $Q_{41}$). Thus the collector current of transistor $Q_{41}$ is effectively controlled by the voltage difference between node 175B and return rail 15B (i.e., the voltage across resistor $R_{43}$).

When Schottky diode $D_{43}$ is conducting and current bypass diodes $D_{44}$ and $D_{45}$ (connected between node 175C and return rail 15B) are not, the current in resistor $R_{43}$ is equal to the sum of the currents in the emitter of transistor $Q_{41}$ and load 18. Resistors $R_{91}$ and $R_{43}$ may be selected so that for currents in load 18 less than a threshold (e.g., the holding current of dimmer 12), the voltage across $R_{43}$ attributable to the current in load 18 causes transistor $Q_{92}$ to draw a small enough collector current that the voltage across $R_{91}$ sets the voltage at node 175A to be sufficiently greater than the voltage at node 175B so as to cause transistor $Q_{41}$ to conduct current from its collector to its emitter. In embodiments where resistors $R_{91}$ and $R_{43}$ are so selected, transistor $Q_{41}$ will draw current when it is necessary to supplement the current drawn by load 18 to maintain at least a holding current through dimmer 12.

Resistors $R_{91}$ and $R_{43}$ may be selected so that for currents in load 18 greater than a threshold (e.g., the holding current of dimmer 12), the voltage across $R_{43}$ attributable to the current in load 18 causes transistor $Q_{92}$ to draw a large enough collector current that the voltage across $R_{91}$ sets a voltage at node 175A that is not sufficiently greater than the voltage at node 175B such that transistor $Q_{41}$ does not conduct current from its collector to its emitter. In embodiments where resistors $R_{91}$ and $R_{43}$ are so selected, transistor $Q_{41}$ will not draw current from dimmer 12 when the current drawn by load 18 is sufficient to maintain a holding current through dimmer 12.

It will be appreciated that the configuration of holding current circuit 140 provides negative feedback control on the collector current of transistor $Q_{41}$. In operation, when the current through load 18 is sufficiently small to cause a current in resistor $R_{43}$ that results in a voltage at node 175B less than the voltage at node 175A, transistor $Q_{41}$ draws current from voltage supply rail 15A to supply additional current to resistor $R_{43}$. As transistor $Q_{41}$ draws more current, additional current flows in resistor $R_{43}$, causing the voltage at node 175B to increase. The increase in voltage at node 175B causes transistor $Q_{92}$ to conduct more current, and this current flows through resistor $R_{91}$. The increase in current in $R_{91}$ is reflected in a lower voltage at node 175A. Since the difference between the voltages at nodes 175A and 175B controls the collector current of transistor $Q_{41}$, increasing the voltage at node 175B while decreasing the voltage at node 175A throttles the collector current of transistor $Q_{41}$.

When dimmer 12 is not in conduction (e.g., during the 'off' portion of a phase-cut voltage half-wave), the voltage at supply rail 15A and return rail 15B will be approximately the same. As a result, the voltage at node 175A cannot be greater than the voltage at node 175B to cause transistor $Q_{41}$ to conduct, and holding current circuit 140 does not draw current from supply rail 15A.

As compared with circuit 70, circuit 170 may be more easily configured for predictable operation across a range of temperatures. Whereas in circuit 70, diodes $D_{41}$ and $D_{42}$ will typically have different thermal characteristics than transistor $Q_{41}$, in circuit 170, transistors $Q_{41}$ and $Q_{92}$ may be selected to have similar thermal characteristics. As a result, the operational parameters of transistors $Q_{41}$ and $Q_{92}$ (e.g., intrinsic semiconductor current between the collector and base, base-emitter voltage turn-on voltage, gain etc.) will have similar temperature coefficients, and changes in behaviour of transistors $Q_{41}$ and $Q_{92}$ due to changes in temperature may be similar and self-equalizing due to the feedback configuration of transistors $Q_{41}$ and $Q_{92}$.

FIGS. 8A, 8B, 9A and 9B show graphs of modeled time-varying voltages and currents in electrical circuits like circuit 170. In comparison with the circuit which provided the waveforms shown in FIGS. 8A and 8B, the load of the circuit which provided the waveforms shown in FIGS. 9A and 9B has a higher impedance. Graphs 190A and 200A show, respectively, waveforms 191 and 201 representing full-wave, rectified AC voltages on voltage supply rail 15A. Waveforms 191 and 201 represent AC voltages having root mean square voltages of approximately 120 volts and frequency of 60 Hertz. Graphs 190B and 200B show, respectively, three current waveforms. Waveforms 192 and 202 represent the current in load 18. Waveform 193 represents the current in resistor $R_{43}$. Waveform 203 represents the input current supplied via voltage supply rail 15A. Waveforms 194 and 204 represent the current in resistor $R_{42}$.

Graphs 190C and 200C show, respectively, waveforms 195 and 205 representing leading-edge phase-cut rectified AC voltages on voltage supply rail 15A. Waveforms 195 and 205 represent leading-edge phase-cut rectified AC voltages derived from input AC voltages having a root mean square voltages of approximately 120 volts and frequency of 60 Hertz. Graphs 190D and 200D show, respectively, three current waveforms. Waveforms 196 and 206 represent the current in load 18. Waveform 197 represent the current in resistor $R_{43}$. Waveform 207 represents the input current supplied via voltage supply rail 15A. Waveforms 198 and 208 represent the current in resistor $R_{42}$.

Comparison of graphs 90B and 90D with graphs 190B and 190D, and of graphs 100B and 100D with graphs 200B and 200D shows that the configuration of holding circuit 140 provides a faster response to load currents that fall below the holding current threshold than holding circuit 40. In particular, the holding current in resistor $R_{43}$ is maintained within a narrower range in holding current circuit 140 as compared with holding current circuit 40 (i.e., when load current is below the minimum threshold, the vertical slope of waveforms 193, 197, 203 and 207 is shallower in comparison with waveforms 93, 97, 103 and 107). This behaviour is due to the different current-voltage characteristics transistor $Q_{92}$ and diodes $D_{41}$ and $D_{42}$ near the forward bias voltage: whereas the current-voltage relationship of transistor $Q_{92}$ is relatively steeply linear, the current-voltage relationship of diodes $D_{41}$ and $D_{42}$ is exponential. Thus, as the voltage on rail 15A falls, the voltage provided at the base of transistor $Q_{42}$ by diodes $D_{41}$ and $D_{42}$ "rolls-off" more gradually as compared with the voltage provided by transistor $Q_{92}$. Holding current circuit 140 also provides holding current at lower input voltages than does holding current circuit 40 due to the lower reference voltage that may be provided by transistor $Q_{92}$ (minimum emitter-collector voltage) as compared to series connected diodes $D_{41}$ and $D_{42}$ (minimum sum of forward voltages).

FIG. 10 is a block diagram of an electrical circuit 230 comprising a holding current circuit 240 according to an example embodiment. Holding current circuit 240 comprises a current-to-voltage converter 244 connected between voltage supply rail 15A and node 15B. Current-to-voltage converter 244 converts the current through it into a voltage across it, which appears at node 245B. A reverse polarity protector 241 is connected between node 245B and the input of load 18 (the control input of holding current circuit 240). Reverse polarity protector 241 is configured to conduct current from node 245B to load 18.

A conduction dependent voltage reference 246 provides a conduction dependent reference voltage at node 245A. A voltage controlled current source 242 is connected between node 245B and return rail 235B. Controlled current source 242 is controlled by the voltage difference $v_k$ between nodes 245B and 245A. In particular, the current in controlled current source 242 is related by gain factor $G_m$ to the difference between the voltage at node 245B and the voltage at node 245A. Thus controlled current source 242 is connected in parallel with the series connection of load 18 and reverse polarity protector 241. Since this parallel connection is in series with a current-to-voltage converter 244, the current in current-to-voltage converter 244 is the sum of the currents in load 18 and controlled current source 242.

It will be appreciated that the operation of holding current circuit 240 is similar to the operation of holding current circuit 40. Holding current circuit 240 differs from holding current circuit 40 in the order that current passes through the current-to-voltage converter (current monitor) and the controlled current source from supply rail 15A to return rail 15B. As a result, the polarity of the voltage that controls the controlled current source is reversed.

Those skilled in the art will recognize that conduction dependent voltage reference 246 of holding current circuit 240 may be a stable conduction dependent voltage reference or may be a controllable conduction dependent voltage reference (e.g., of the type used in holding current circuit 140 of FIG. 6). Holding current circuit 240 may comprise a current feedback source (not shown) in series with current to voltage converter 244, which may provide a current feedback signal to conduction dependent voltage reference 246.

Some embodiments comprise lighting assemblies that comprise lighting loads. FIG. 11A is a block diagram of a lighting assembly 400 according to an example embodiment. Lighting assembly 400 comprises a package 402 and externally accessible terminals 404A and 404B. Package 402 may be configured to conform to a standardized bulb package configuration, such as, for example, general (A), mushroom, pear-shaped (PS), candle (B), twisted candle, bent-tip candle (CA & BA), flame (F), fancy round (P), globe (G), flood type (FL), spot type (SP) and/or the like. Package 402 may be fully or partially transparent and/or translucent. Package 402 may comprise a reflector. In some embodiments, terminals 404A and 404B are configured to conform to a standardized light fitting configuration. For example, terminals 404A and 404B may comprise an Edison screw, double contact bayonet, bipin, wedge, recessed double contact light fitting and/or the like. Terminals 404A and 404B may be connectable to a circuit comprising a dimmer.

Lighting assembly 400 comprises a holding current circuit 406 connected between terminals 404A and 404B. Lighting assembly 400 also comprises lighting control circuit 407 connected between terminal 404A and a control input of holding current circuit 406. An electric light source 408 is connected between a control output of lighting control circuit and the control input of holding current circuit 406. Lighting control circuit 407 may comprise a switched mode power supply, a controller and other components useful for controlling and/or conditioning power supplied to electric light source 408. In some embodiments, electric light source 408 comprises one or more solid-state light sources, such as, for example, a semiconductor light-emitting diode (LEDs), an organic light-emitting diodes (OLED), or a polymer light-emitting diodes (PLED). In some embodiments, electric light source 408 comprises one or more electrical filaments and/or plasma light sources.

Figure 11B:
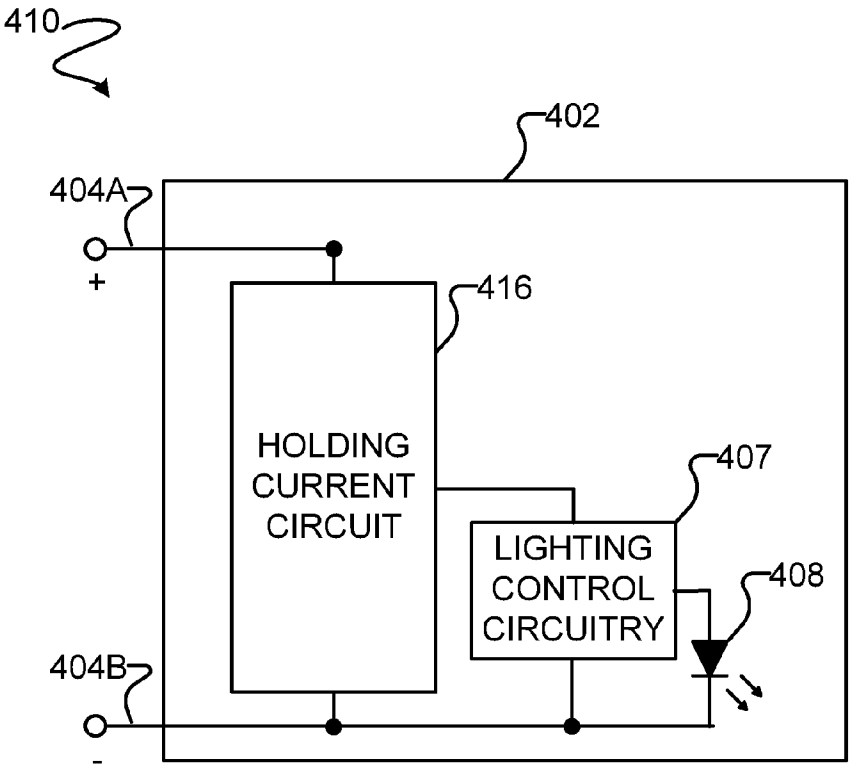
FIG. 11B is a block diagram of a lighting assembly according to an example embodiment.
Figure 11A:
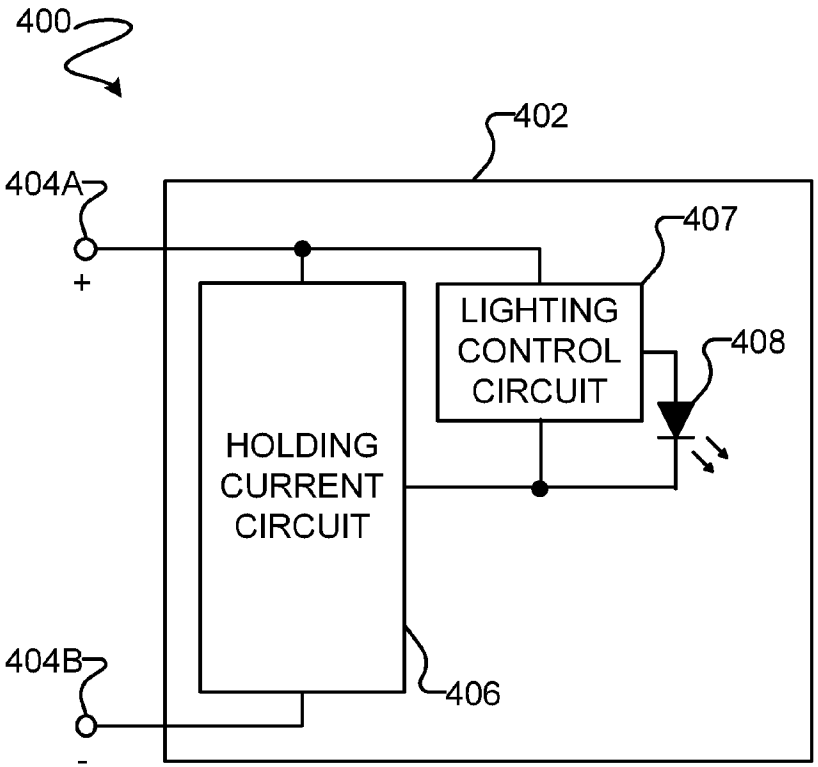
FIG. 11A is a block diagram of a lighting assembly according to an example embodiment.

FIG. 11B is a block diagram of a lighting assembly 410 according to an example embodiment. Lighting assembly 410 is substantially similar to lighting assembly 400, but differs in the arrangement of its electrical components. Lighting assembly 410 comprises a holding current circuit 416 connected between terminals 404A and 404B. Lighting assembly 410 also comprises lighting control circuit 407 connected between a control input of holding current circuit 416 and terminal 404B. Electric light source 408 is connected between a control output of lighting control circuit and terminal 404B.

Lighting assemblies 400 and 410 may comprise additional components, such as diode bridge rectifiers connected between terminals 404A and 404B and holding current circuits 406 and 416, respectively, for example.

Figure 12:
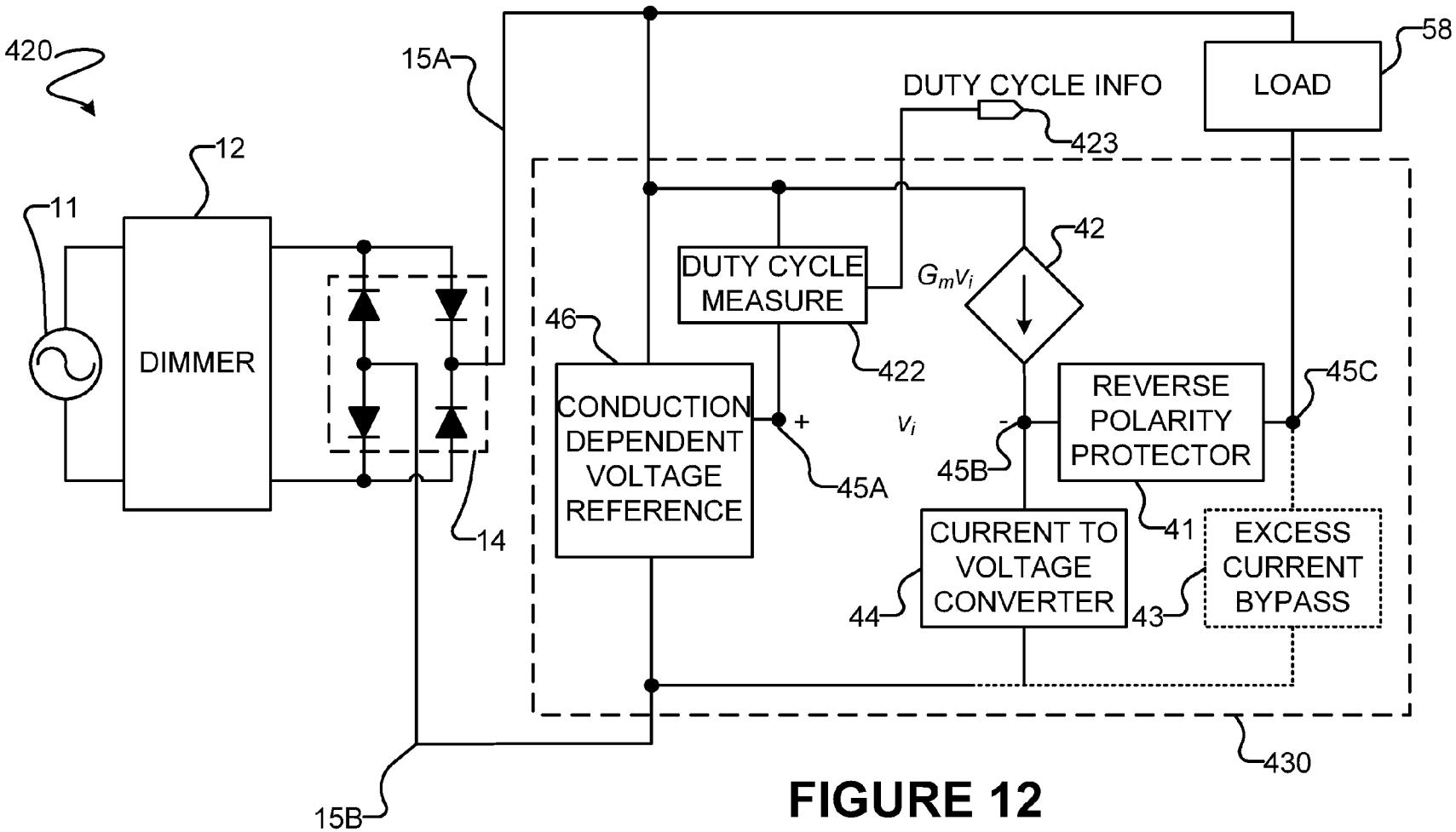
FIG. 12 is a block diagram of an electrical circuit comprising a holding current circuit according to an example embodiment.

FIG. 12 is a block diagram of an electrical circuit 420 that comprises a holding current circuit 430 according to an example embodiment. Holding current circuit 430 is substantially similar to holding current circuit 40 of FIG. 2, but differs in that it additionally comprises a duty cycle measurement circuit 422 connected to the reference voltage output of conduction dependent voltage reference 46. Duty cycle measurement circuit 422 is configured to output a duty cycle signal 423 indicative of the duty cycle of the phase-cut voltage on supply rail 15A. It will be appreciated that the conduction dependent reference voltage output at node 45A by conduction dependent voltage reference 46 may embody duty cycle information. For instance, in embodiments where conduction dependent voltage reference 46 is configured to provide different stable voltages on either side of a phase-cut of voltage on rail 15A, the voltage at node 45A may have the form of a DC pulse train. Duty cycle measurement circuit 422 may be configured to extract and/or otherwise condition duty cycle information embodied in the conduction dependent reference voltage at node 45A.

Figure 13B:
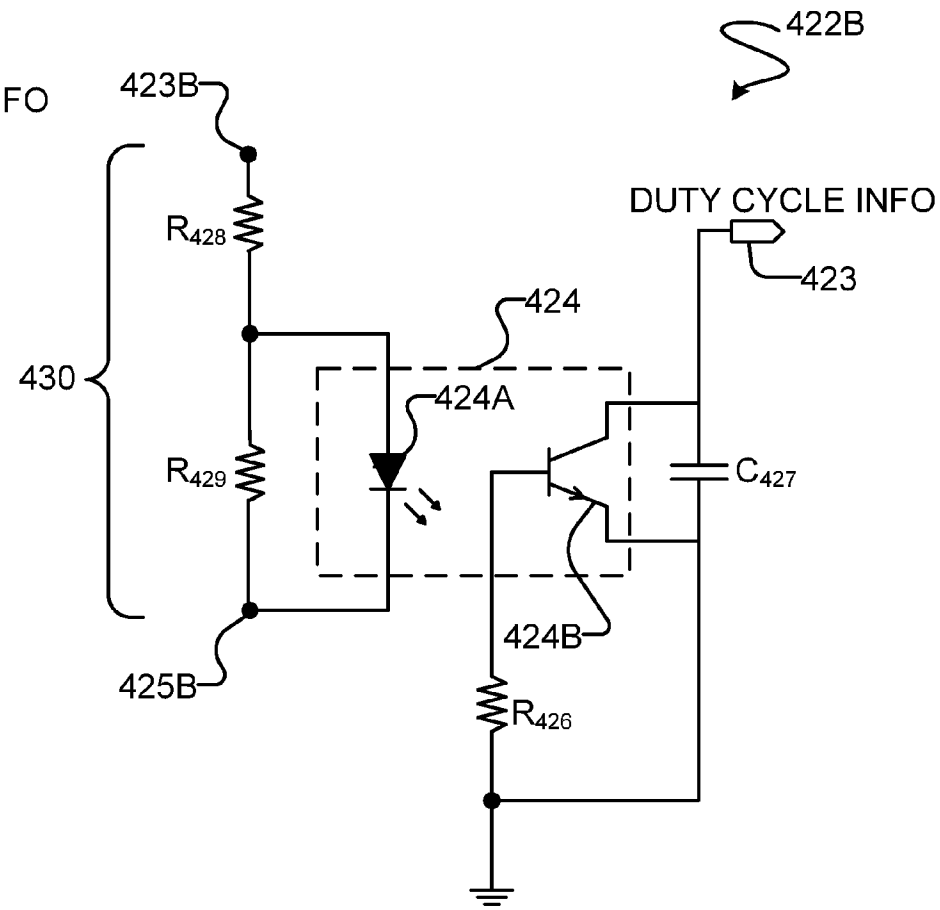
FIG. 13B is a block diagram of a duty cycle measure according to an example embodiment.
Figure 13A:
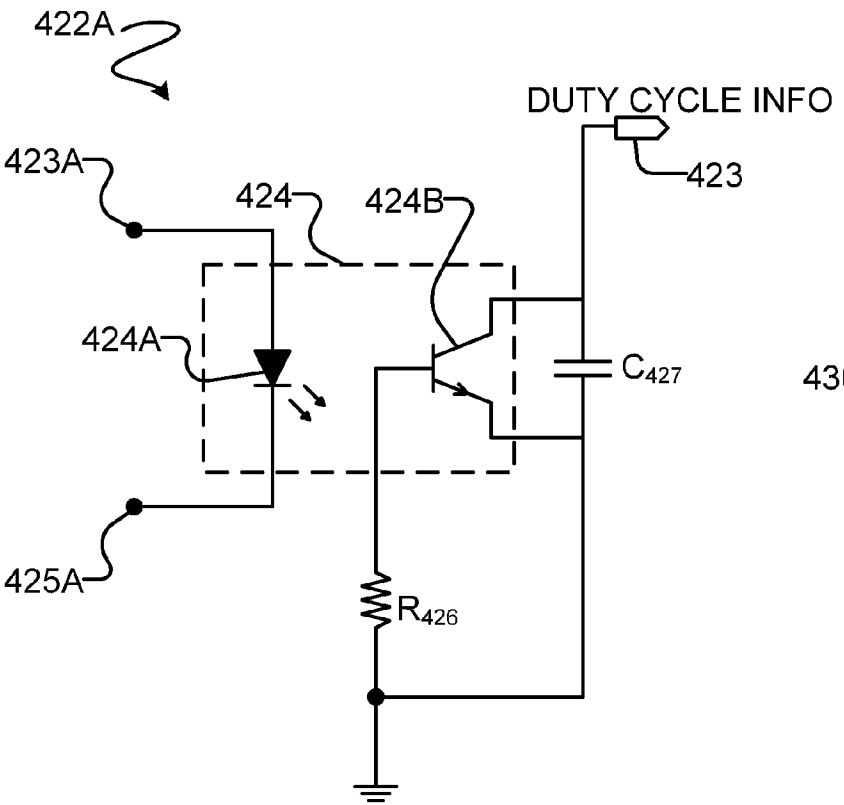
FIG. 13A is a block diagram of a duty cycle measure according to an example embodiment.

FIG. 13A is a block diagram of an example duty cycle measure 422A which may be used as a duty cycle measurement circuit 422 in some embodiments of the type exemplified by the example embodiment shown in FIG. 12. Duty cycle measurement circuit 422A comprises an optocoupler 424 that includes an LED 424A and a phototransistor 424B. Voltage across terminals 423A and 425A causes current to flow through LED 424A, which causes LED 424A to emit light. Light from LED 424A impinges on phototransistor 424B, inducing a voltage between the collector and emitter of phototransistor 424B. Optocoupler 424 provides duty cycle information signal 423 proportional to the current through LED 424A, which is proportional to the voltage across terminals 423A and 425B. When duty cycle measurement circuit 422A is used in a holding current circuit, duty cycle information signal output 423 is galvanically isolated from the holding current circuit by optocoupler 424.

FIG. 13B is a block diagram of an example duty cycle measurement circuit 422B which may be used as a duty cycle measurement circuit 422 in some embodiments of the type exemplified by the example embodiment shown in FIG. 12. Duty cycle measure 422B differs from duty cycle measure 422A in that it comprises a voltage divider 430 that includes resistor $R_{428}$ and resistor $R_{429}$. Voltage divider 430 causes only a portion of the voltage between terminals 423B and 425B to fall across LED 424A, thereby proportionally reducing the magnitude of current in LED 424A and the amount of light incident on phototransistor 424B.

Figure 14:
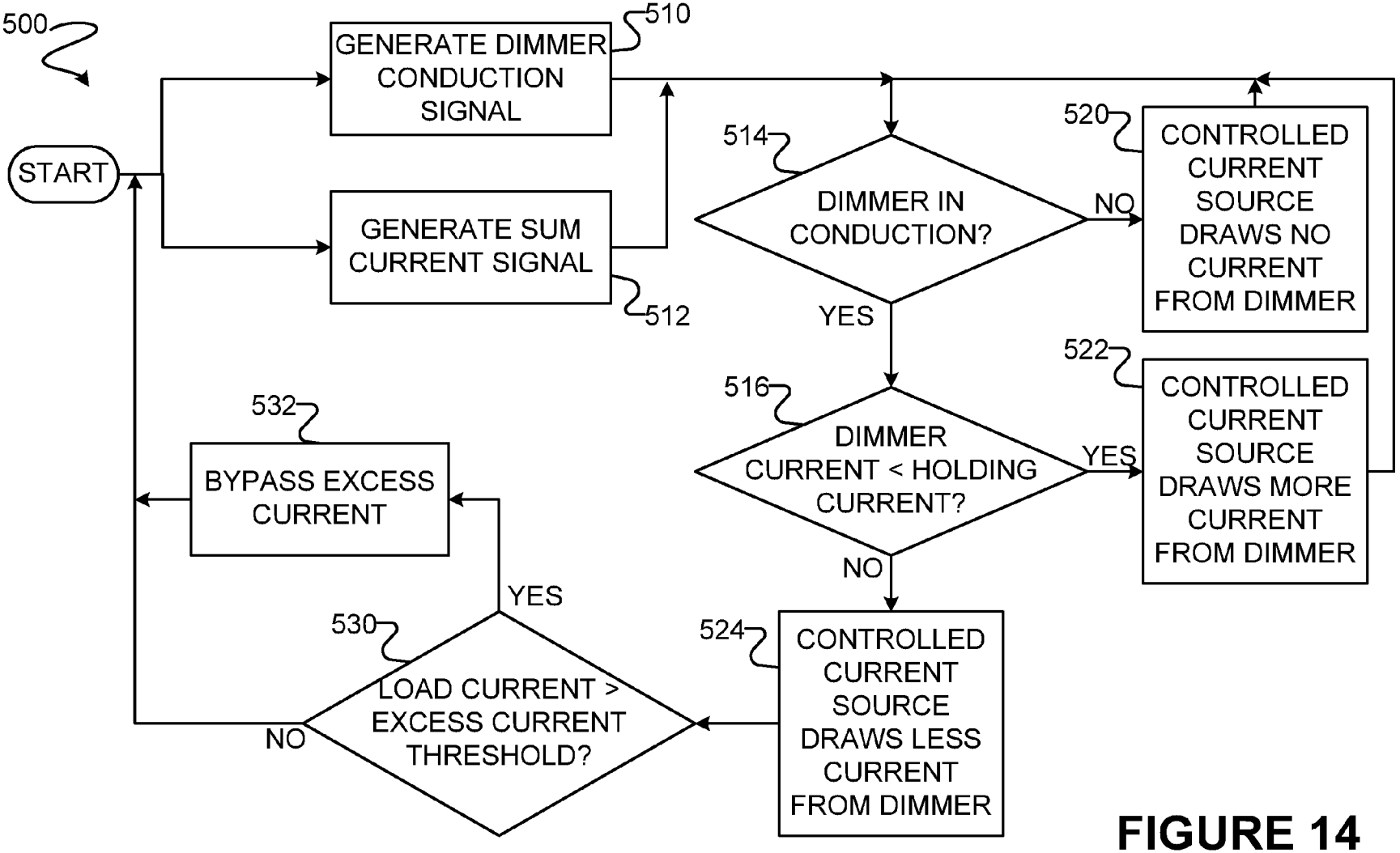
FIG. 14 is a flow chart of a method according to an example embodiment.

FIG. 14 is a flow chart of method 500 for maintaining a holding current in a dimmer according to an example embodiment. In method 500, the conduction state of the dimmer is determined (step 514). When the dimmer is not in conduction (step 514, NO), a controlled current source draws no current from the dimmer (step 520). When the dimmer is in conduction (step 514, YES) and the dimmer current is less than the holding current (step 516, YES), the controlled current source draws more current from the dimmer (step 522). When the dimmer is in conduction (step 514, YES) and the dimmer current is less than the holding current (step 516, NO), the controlled current source draws less current from the dimmer (step 524).

In some embodiments, method 500 comprises determining whether the dimmer current is less than the holding current based on a sum current signal proportional to the sum of the currents in the controlled current source and a load connected to draw current from the dimmer. In such embodiments, method 500 comprises a feedback loop. In some such embodiments, determining whether the dimmer current is less than the holding current (step 516) may comprise comparing the sum current signal with a reference signal.

In some embodiments, method 500 comprises generating a sum current signal proportional to the sum of the currents in the controlled current source and the load (optional step 512). It will be appreciated that in embodiments where the load and the controlled current source are the only components drawing appreciable amounts of current from the dimmer, the sum current signal generated in step 512 is strongly indicative of the current in dimmer. In some embodiments, generating a sum current signal proportional to the sum of the currents in the controlled current source and the load comprises summing the currents in the controlled current source and the load. In some embodiments, generating a sum current signal proportional to the sum of the currents in the controlled current source and the load comprises summing a portion of the current in the controlled current source and a portion of the current in the load. In some embodiments, generating a sum current signal proportional to the sum of the currents in the controlled current source and the load comprises generating current monitor signals indicative of the magnitude of the currents in the controlled current source and the load, and summing the current monitor signals. A sum current signal may be generated using different and/or additional methods.

In some embodiments, method 500 comprises generating a dimmer conduction signal (optional step 510) indicative of the conduction state of the dimmer. Generating a dimmer conduction (step 510) signal may comprise generating a voltage signal based on the voltage output by the dimmer. In some embodiments, steps 514 and 516 are combined, and comprise determining a difference between the dimmer conduction signal and the sum current signal. For example, steps 514 and 516 in combination may comprise determining a difference between a dimmer conduction voltage signal and a sum current voltage signal.

In some embodiments, generating a dimmer conduction signal (step 510) comprises generating a signal based on the conduction state of the dimmer and inversely proportioned to sum current signal. In some embodiments, steps 514 and 516 are combined, and comprise determining a difference between such a dimmer conduction signal and the sum current signal.

In some embodiments, step 510 comprises generating a dimmer conduction signal indicative of the fact that the dimmer has been in conduction for at least predetermined period of time rather. In some embodiments, step 510 comprises generating a dimmer conduction signal indicative of the fact that the dimmer will enter conduction in less than a predetermined period of time.

In the illustrated embodiment, method 500 comprises the optional steps of bypassing excess load current (step 532) when the load current is greater than an excess current threshold (step 530). In some embodiments, step 532 comprises shunting a portion of the current in the load away from a current monitor configured to generate the sum current signal. The shunted portion of the sum current may comprise the portion of the load current in excess of the excess current threshold.

Figure 15:
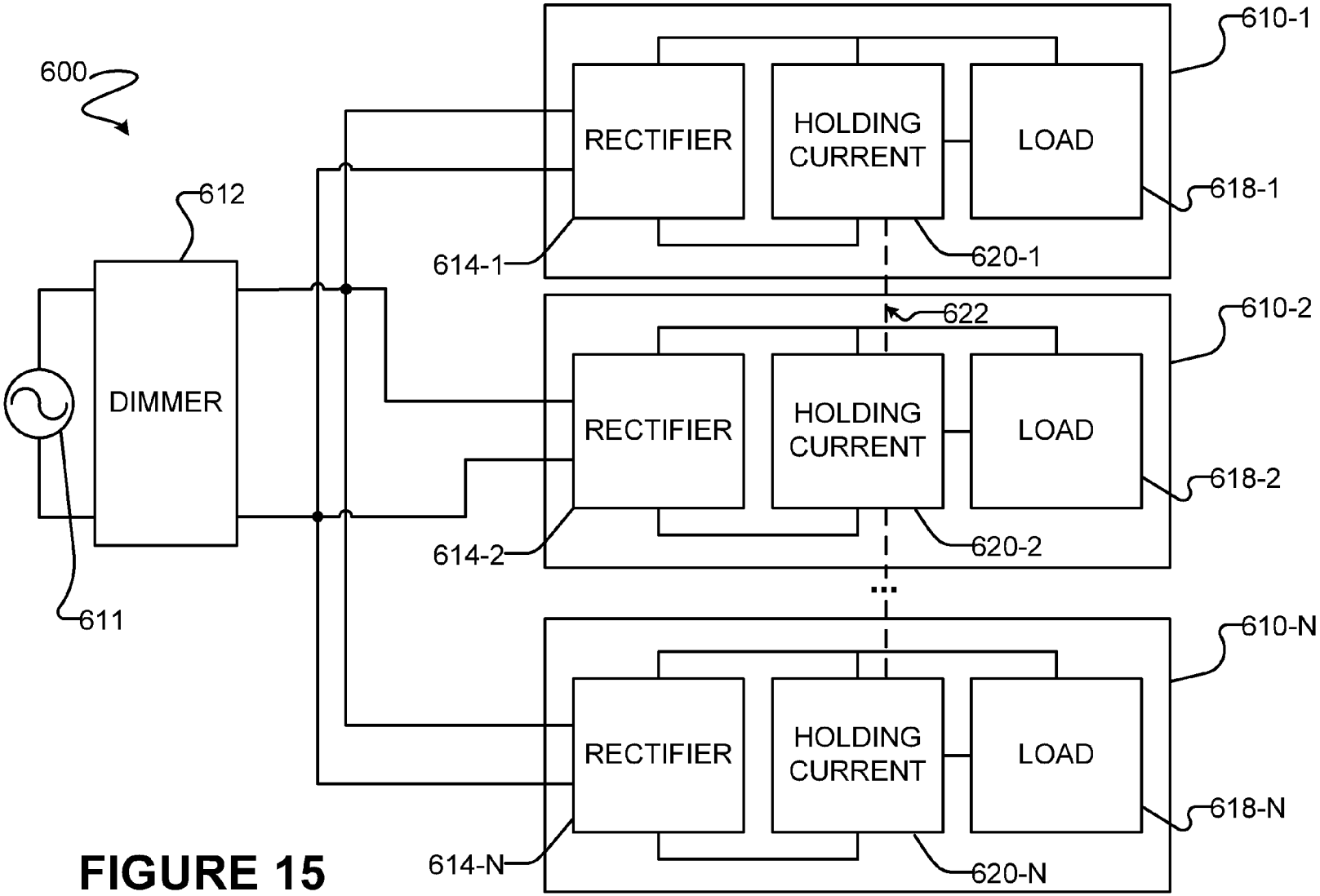
FIG. 15 is a block diagram of a dimming circuit comprising a plurality of holding current circuits according to an example embodiment.

FIG. 15 is a block diagram of a dimming circuit 600 comprising a plurality of holding current circuits according to an example embodiment. Dimming circuit 600 comprises an AC power source 611, a phase-cut dimmer 612 and a plurality of N load assemblies (three load assemblies, individually labeled as 610-1, 610-2 and 610-N are shown in FIG. 15, but it is to be understood that circuit 600 could comprise any number of load assemblies). Load assemblies 610-1, 610-2 and 610-N are connected to draw current from dimmer 612 in parallel.

Each load assembly 610-1, 610-2 and 610-N comprises a rectifier (614-1, 614-2 and 614-N, respectively), a load (618-1, 618-2 and 618-N, respectively) and a holding current circuit (620-1, 620-2 and 620-N, respectively). Loads 618-1, 618-2 and 618-N may be lighting loads, such as, for example, semiconductor light-emitting diodes (LEDs), an organic light-emitting diodes (OLEDs), polymer light-emitting diodes (PLEDs) or the like. Holding current circuits 620-1, 620-2 and 620-N are connected to receive load currents of loads 618-1, 618-2 and 618-N, respectively, and connected to selectively draw supplementary current from dimmer 612. Holding current circuits 620-1, 620-2 and 620-N may comprise holding current circuits having features of one or more of the example holding current circuits disclosed herein or of other types of holding current circuits.

Where any one of holding current circuits 620-1, 620-2 and 620-N is configured so that its respective load assembly draws at least a holding current from dimmer 612, any current drawn by the other holding current circuits is unnecessary to maintain at least the holding current in dimmer 612. Holding current circuits 620-1, 620-2 and 620-N may be configured to jointly maintain at least a holding current in dimmer 612 in a manner that avoids or minimizes unnecessary current draws. As one skilled in the art will appreciate, such a configuration provides increased energy efficiency in comparison to a system wherein a plurality of holding current circuits each draw at least the holding current from a single dimmer.

In some embodiments, circuit 600 is initially turned on, all of holding current circuits 620-1, 620-2 and 620-N are active, and each of load assemblies 610-1, 610-2 and 610-N are configured to periodically transmit an active state signal on the power line (such as, for example a high frequency spike) indicating the active state of the associated holding current circuit. Each of load assemblies 610-1, 610-2 and 610-N are configured to receive active state signals from the other load assemblies 610-1, 610-2 and 610-N. At a random time interval (which may be different for each of load assemblies 610-1, 610-2 and 610-N) each of load assemblies 610-1, 610-2 and 610-N stops sending active state signals and listens for active state signals from other ones of load assemblies 610-1, 610-2 and 610-N. If a load assembly 610-1, 610-2 or 610-N receives an active state signal the associated holding current circuit is deactivated and stops sending active state signals. If a load assembly 610-1, 610-2 or 610-N does not receive an active state signal, the associated holding current circuit remains active. Thus, the holding current circuits of all but one of load assemblies 610-1, 610-2 and 610-N may be deactivated. There is a small chance that the last two of load assemblies 610-1, 610-2 and 610-N could stop and listen at the same time. This risk may be mitigated, for example, by providing a "safety round" wherein each load assemblies 610-1, 610-2 or 610-N keeps sending active state signals, and stops at a second (different) random time interval. Only when one of load assemblies 610-1, 610-2 and 610-N hears nothing twice in a row does it know for sure it is the last assembly with an active holding current circuit. Alternatively, each of load assemblies 610-1, 610-2 and 610-N may stop sending active state signals and listen for active state signals from other ones of load assemblies 610-1, 610-2 and 610-N at a random time, rather than a random time interval. In such an embodiment, in the case the last two of load assemblies 610-1, 610-2 and 610-N stop at the same random time, they will both keep their associated holding current circuit active until the next time one of them stops.

In some embodiments, each of holding current circuits 620-1, 620-2 and 620-N is configured to maintain at least a portion of the holding current in dimmer 612. For example, each of holding current circuits 620-1, 620-2 and 620-N may be configured such that its respective load assembly draws a current of at least 1/N of the holding current. In some embodiments, the portion of the holding current maintained by each of holding current circuits 620-1, 620-2 and 620-N is configurable. For example, holding current circuits 620-1, 620-2 and 620-N may comprise interfaces (e.g., physical interface such as switches, or the like, or electronic or electrical interfaces for receiving signals) for specifying the portion of a holding current each circuit is to maintain (e.g., a switch may be set or a signal may be provided to specify that a number m of holding current circuits are on a dimming circuit, and the holding current circuit associated with the switch will maintain a current of at least 1/m of the holding current). An interface may be configurable to specify that an associated holding current circuit is to maintain a null portion of a holding current (i.e., that the holding current circuit is not to draw any current).

In some embodiments, holding current circuits 620-1, 620-2 and 620-N are communicatively coupled via optional communication links 622. Communication links 622 may be point-to-point, point-to-multipoint or a combination thereof. Communication links 622 may comprise wired links (e.g., electrical wiring) or wireless links.

In embodiments where holding current circuits 620-1, 620-2 and 620-N are communicatively coupled via communication links 622, holding current circuits 620-1, 620-2 and 620-N may be configured to maintain at least the holding current in dimmer 612 in a coordinated manner. For example, holding current circuits 620-1, 620-2 and 620-N may be configured to receive signals indicative of current drawn by the other holding current circuits, and to draw current from dimmer 612 based at least in part on these signals.

In some embodiments, dimming circuit 600 may comprise additional circuitry (not shown) for disabling all but one of holding current circuits 620-1, 620-2 and 620-N (or all but a minimum number of holding current circuits 620-1, 620-2 and 620-N sufficient to maintain the dimmer in conduction in embodiments wherein each holding current circuit is configured to draw only a portion of the holding current). Such additional circuitry may comprise, for example, voltage references, comparators, and sample and hold circuits configured to receive signals from each of holding current circuits 620-1, 620-2 and 620-N and, in response to a signal indicating that one of holding current circuits 620-1, 620-2 and 620-N is drawing supplementary current, provide a disable signal to the other ones of holding current circuits 620-1, 620-2 and 620-N.

In some embodiments, holding current circuits 620-1, 620-2 and 620-N comprise optional coordination controllers (not shown) that are communicatively coupled via communication links 622. Coordination controllers may be configured to communicate with one another by any suitable protocol (e.g., a polling protocol, a broadcast protocol, etc.).

In embodiments where holding current circuits 620-1, 620-2 and 620-N comprise coordination controllers that are communicatively coupled via communication links 622, the coordination controllers may be configured to coordinate maintenance of at least a holding current in dimmer 612. For example, a coordination controller of at least one of holding current circuits 620-1, 620-2 and 620-N may configured to cause its associated holding current circuit to maintain at least the holding current in dimmer 612, and be configured to communicate a disable signal to a coordination controller of at least one other of holding current circuits 620-1, 620-2 and 620-N. The coordination controller of the at least one other holding current circuit may configured to cause its associated holding current circuit to not draw current from dimmer 612 when it receives the disable signal.

For another example, a coordination controller of each of holding current circuits 620-1, 620-2 and 620-N may configured to communicate its existence to the others; to determine, based on communications of existence from coordination controllers of the other holding current circuits, the number N of holding current circuits on dimming circuit 600; and to configure its associated holding current circuit to maintain a current of at least 1/N of the holding current.

Figure 16:
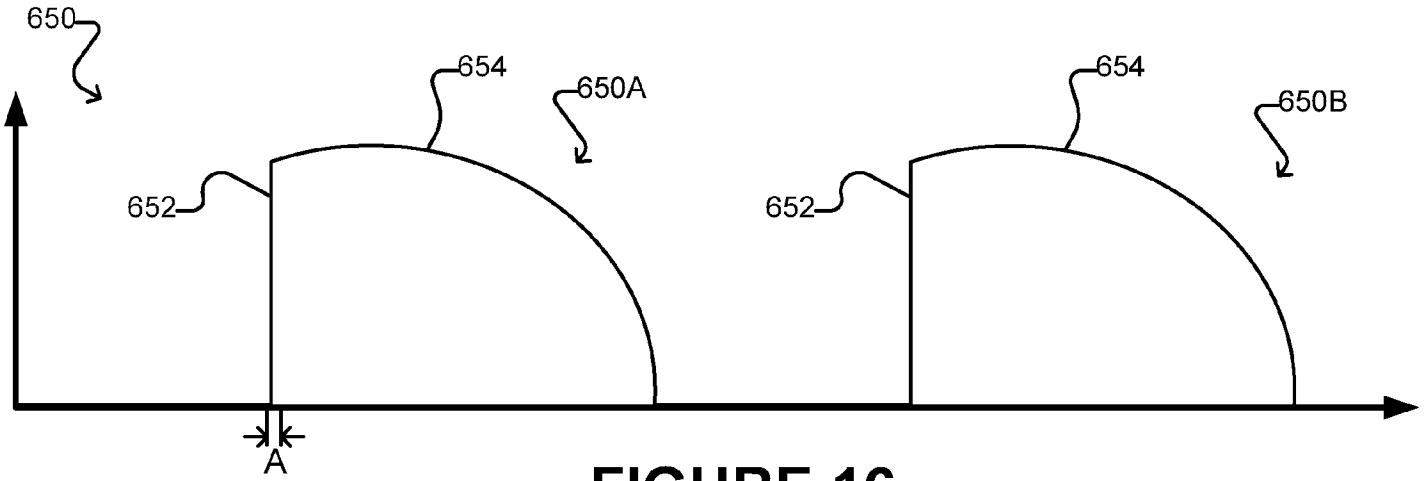
FIG. 16 is a graph showing example currents versus time from a leading edge phase-cut dimmer.
Figure 16B:
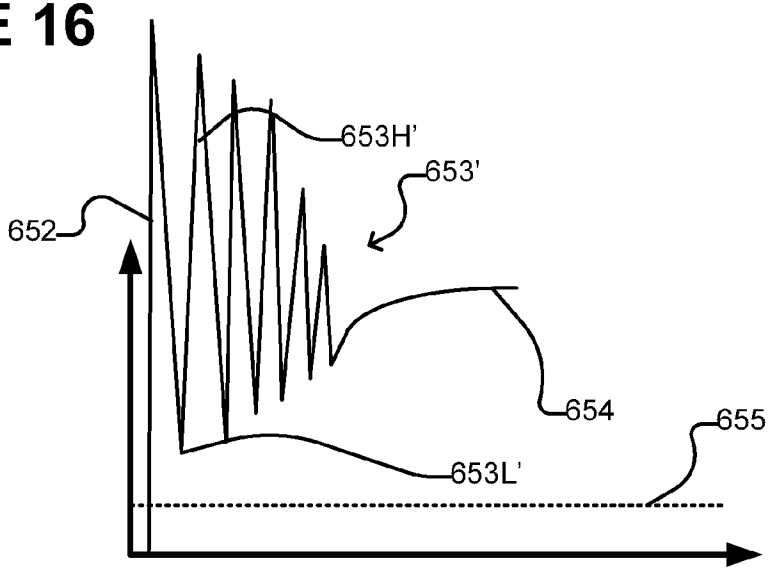
FIG. 16B is a graph similar to that of FIG. 16A with a current offset applied to the transients.
Figure 16A:
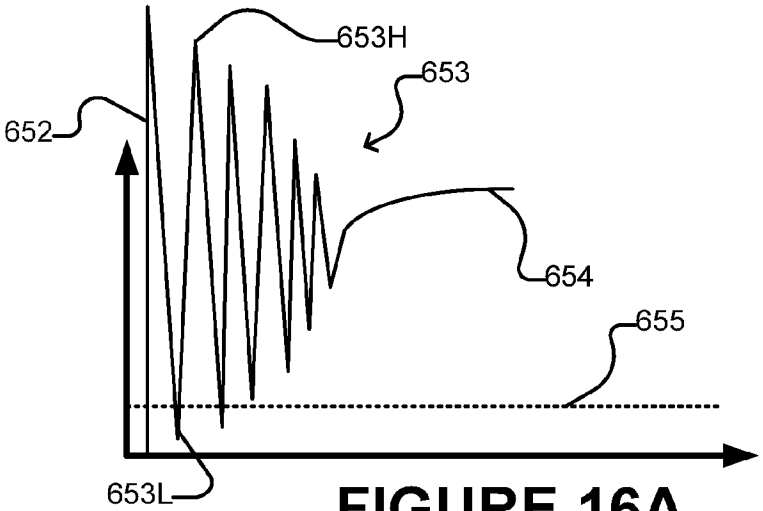
FIG. 16A is a graph of portion A of FIG. 16 on a smaller timescale showing an example of transients which may occur when dimmers enter conduction.

In some implementations employing a leading-edge phase-cut dimmer, transients may occur in the current drawn through the dimmer for a short period just after the dimmer enters conduction. FIG. 16 shows an example current waveform 650 generated from a leading-edge phase-cut dimmer. Waveform 650 comprises two example half-wave-rectified phase-cut pulses 650A and 650B. Each of pulses 650A and 650B has a leading edge 652 followed by a sinusoidal portion 654. As seen in FIG. 16A, leading edge 652 may be followed by a brief "ringing" or transient portion 653 wherein the current through the dimmer oscillates rapidly through a wide range of levels. Transient portion 653 comprises a plurality of local maximums 653H and minimums 653L. The particular characteristics of transient portion 653 will vary depending on the type of dimmer and the nature of the circuit(s) connected thereto. For example, in some implementations transient portion may have a duration of about 50 to 100 microseconds, and may comprise a plurality of oscillations having a period of about 6 to 9 microseconds. In some situations, transient portion 653 (in particular, minimums 653L) can result in the current through the dimmer dropping below a holding current level 655, which can turn off the dimmer. In some situations, the duration for which transient portion 653 is at risk of turning off the dimmer lasts about 6 to 9 microseconds (e.g., the period of the first transient oscillation).

Some embodiments provide apparatus and methods for drawing a supplementary offset current through the dimmer just after the leading edge of a phase-cut waveform to provide a positive current offset to any transients. FIG. 16B shows an example waveform wherein transient portion 653' has been offset such that minimums 653L' never fall below holding current level 655. In some embodiments, the supplementary offset current may be at least the holding current. In some embodiments, the supplementary offset current may be higher than the holding current (e.g., about three times the holding current).

Figure 17A:
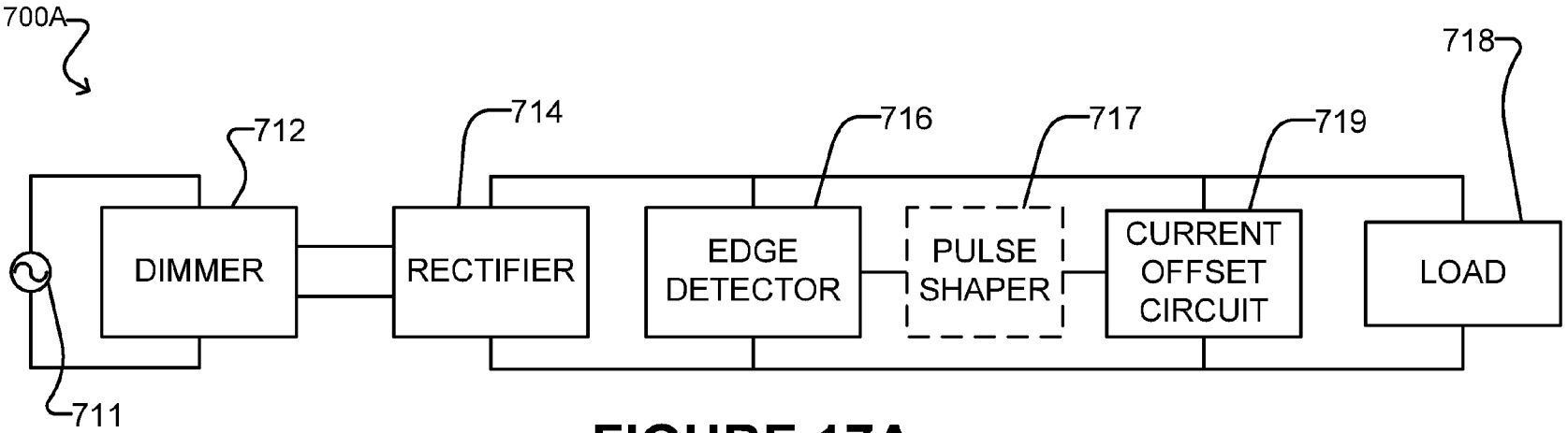
FIG. 17A is a block diagram of an electrical circuit comprising an edge pulse generator and a current offset circuit according to an example embodiment.
Figure 17B:
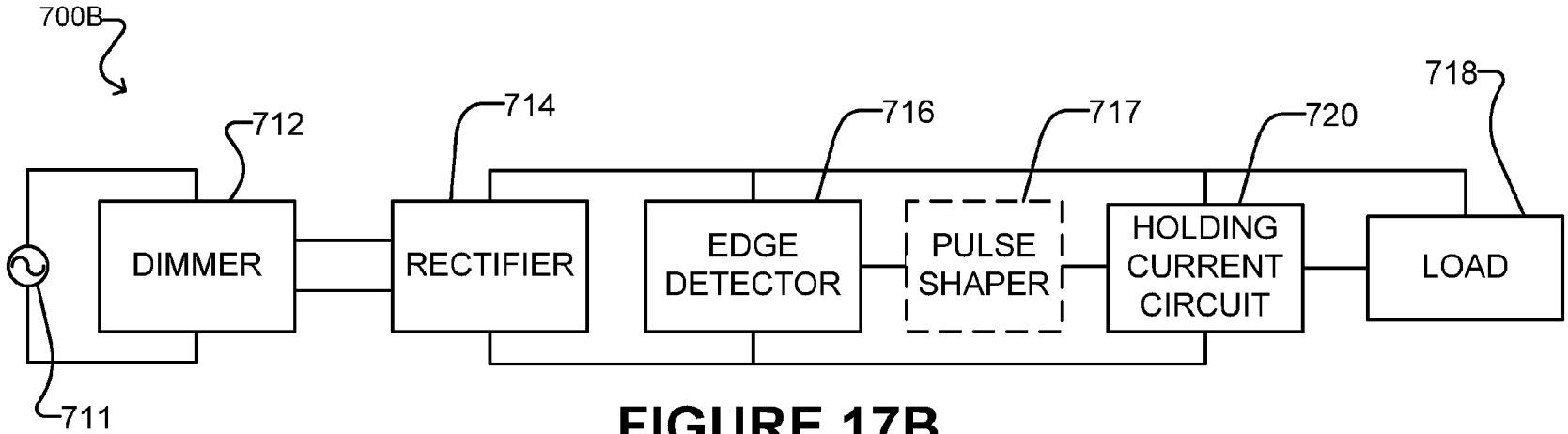
FIG. 17B is a block diagram of an electrical circuit comprising an edge pulse generator and a holding current circuit according to an example embodiment.

FIGS. 17A and 17B are block diagrams of example circuits 700A and 700B for ameliorating the effects of transients which may occur when a leading-edge phase-cut dimmer enters conduction. In each of circuits 700A and 700B, an AC power source 711 provides power to a load 718 through a leading-edge phase-cut dimmer 712. The dimmer-modulated power output by dimmer 712 is rectified by a rectifier 714. An edge detector 716 detects the leading edge of the rectified dimmer output and generates a leading edge signal in response thereto. The leading edge signal may comprise, for example, a voltage or current pulse. In some embodiments the leading edge signal may comprise a pulse having a generally rectangular envelope with a duration based on an expected duration of the transient portion. In some embodiments the leading edge signal may have an envelope which is shaped based on an expected transient envelope shape. Basing the envelope shape of the leading edge signal on the envelope shape of the transient portion may provide power savings in some embodiments by reducing the amount of supplementary offset current drawn during the end of transient portion, when the oscillations of the transient portion have smaller amplitude.

In circuit 700A of FIG. 17A, the leading edge signal is provided as a control voltage to a current offset circuit 719. Current offset circuit 719 is configured to momentarily draw a supplementary offset current through dimmer 712 in response to the leading edge signal. The supplementary offset current drawn by current offset circuit 719 serves to increase the current drawn through dimmer 712 during the transient portion such that the current through dimmer 712 never drops below the holding current.

In circuit 700B of FIG. 17B, the leading edge signal is provided as a control voltage to a holding circuit 720. Holding current circuit 720 may, for example, comprise any of the example holding current circuits described above, or another type of holding current able to respond quickly enough to draw supplementary offset current in response to the leading edge signal such that the current through dimmer 712 never drops below the holding current during the transient portion. Holding current circuit 720 may thus perform a dual purpose by ameliorating the effect of transients by drawing a supplementary offset current immediately following the leading edge of a phase-cut waveform, and also drawing supplementary current near the trailing edge of the voltage waveform in response to the instantaneous value of the load current as discussed above.

Circuits 700A and 700B may also comprise an optional pulse shaper 717 which receives the leading edge signal and applies a predetermined envelope shape to the leading edge signal. Pulse shaper 717 may be configured such that the control voltage provided to current offset circuit 719/holding current circuit 720 corresponds to an expected transient envelope shape, such that supplementary offset current drawn during the transient portion is based on the amplitude of the oscillations of the transient portion.

Figure 18:
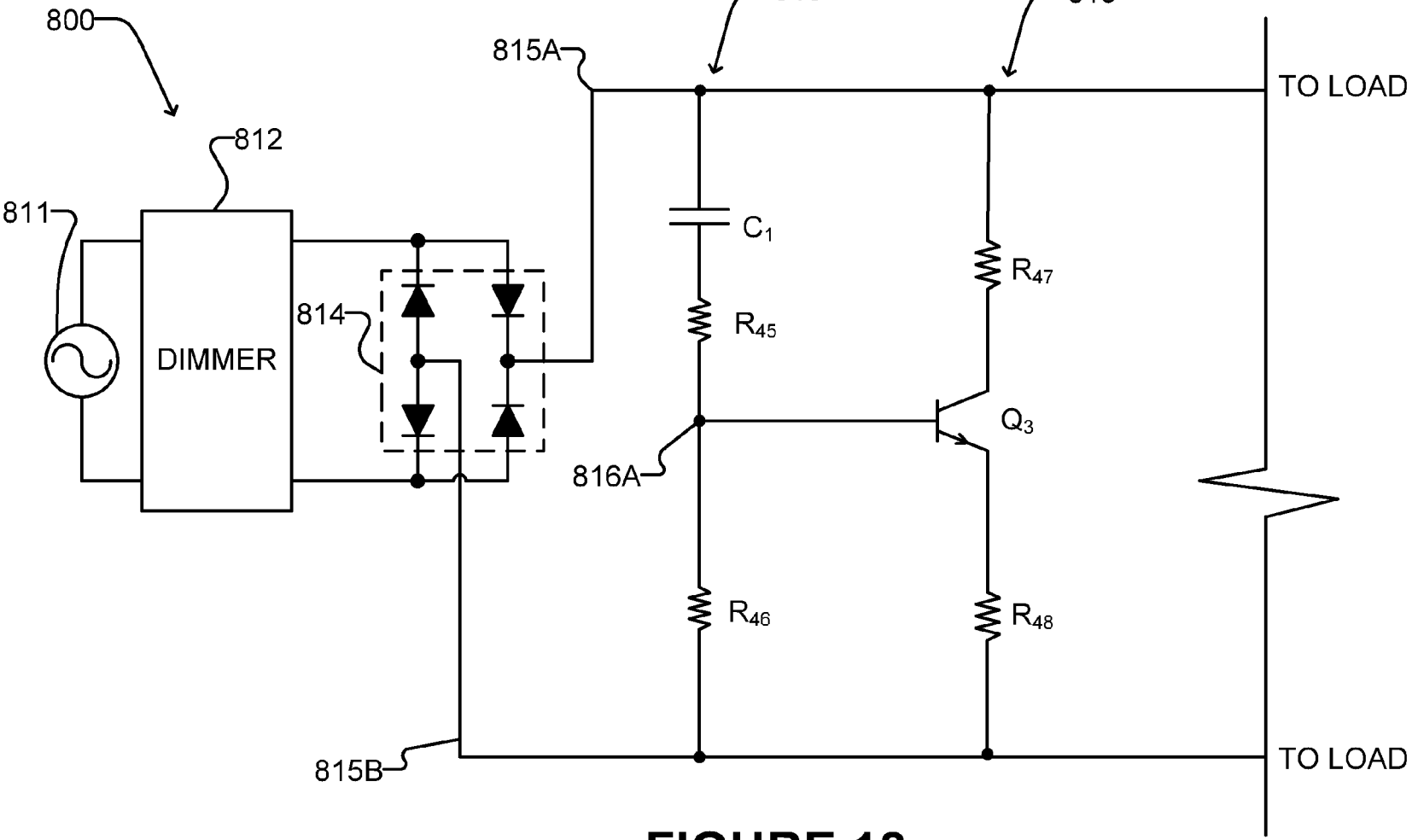
FIG. 18 is a schematic of an electrical circuit comprising an edge pulse generator and a holding current circuit according to an example embodiment.

FIG. 18 is a schematic of an example electrical circuit 800 comprising an AC power source 811, a dimmer 812, and a rectifier 814, which provide rectified, dimmer-modulated supply voltage across supply rail 815A and return rail 815B. Rails 815A and 815B are also connected to power a load (not shown), optionally through a separate holding current circuit (not shown). An edge detector 816 is formed by capacitor $C_1$ and resistors $R_{45}$ and $R_{46}$. A current offset circuit 819 is formed by transistor $Q_3$ and resistors $R_{47}$ and $R_{48}$. Resistor $R_{45}$ may, for example, have a resistance of 60 kΩ. Resistor $R_{46}$ may, for example, have a resistance of 1 kΩ. Capacitor $C_1$ may, for example, have a resistance of 1 nF. Node 816A between resistors $R_{45}$ and $R_{46}$ is connected to the base of transistor $Q_3$. When the leading edge of a phase-cut waveform is provided to rails 815A and 815B, current induced in capacitor $C_1$ raises the voltage at node 816A and thus the base of transistor $Q_3$, which is temporarily above the voltage at the emitter of transistor $Q_3$, thus turning on transistor $Q_3$ and causing supplementary offset current to be drawn through transistor $Q_3$ and resistors $R_{47}$ and $R_{48}$. As one skilled in the art will appreciate, an edge detector may be implemented in other ways than as described in the above example. For example, in other embodiments edge detectors may be implemented using other components including, for example digital logic blocks such as TTL integrated circuits, op-amps and/or inverters.

Figure 19:
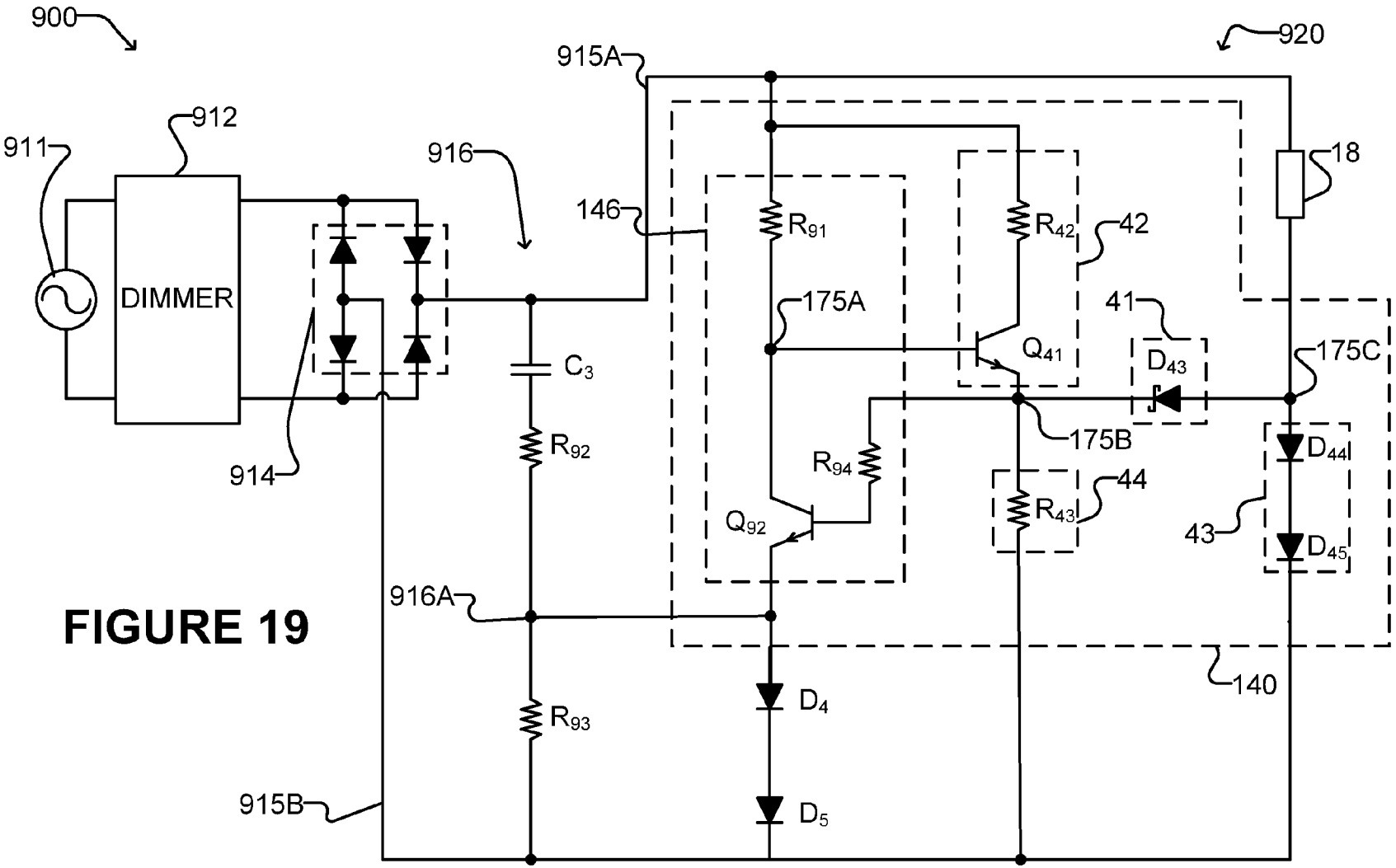
FIG. 19 is a schematic of an electrical circuit comprising an edge pulse generator and a holding current circuit according to an example embodiment.

FIG. 19 is a schematic of an example electrical circuit 900 comprising an AC power source 911, a dimmer 912, and a rectifier 914, which provide rectified, dimmer-modulated supply voltage across supply rail 915A and return rail 915B for powering a load 918. It is to be understood that power source 911, dimmer 912 and load 918 need not be provided with the other components of circuit 900, and some embodiments may provide a circuit similar to circuit 900 with connectors for connecting to power dimmer 912 and load 918. An edge detector 916 is formed by capacitor $C_3$ and resistors $R_{92}$ and $R_{93}$. Resistor $R_{92}$ may, for example, have a resistance of 50 kΩ. Resistor $R_{93}$ may, for example, have a resistance of 250Ω. Capacitor $C_3$ may, for example, have a resistance of 1 nF. A holding current circuit 920 is also provided in circuit 900. Holding current circuit 920 is substantially similar to circuit 170 of FIG. 7, and elements common to circuit 920 and circuit 170 are labeled with the same reference numerals and will not be described in detail again. Node 916A between resistors $R_{92}$ and $R_{93}$ is connected to the emitter of transistor $Q_{92}$ to provide a control voltage for controlling the drawing of supplementary offset current by holding current circuit 920. Diodes $D_4$ and $D_5$ provide a reference voltage for node 916A and the emitter of transistor $Q_{92}$. When the leading edge of a phase-cut waveform is provided to rails 915A and 915B, current induced in capacitor $C_3$ raises the voltage at node 916A and thus the emitter of transistor $Q_{92}$. This turns transistor $Q_{92}$ off (as the voltage at the emitter is temporarily above the voltage at the base), which in turn drives the voltage at node 175A higher, thereby momentarily turning on transistor $Q_{41}$ to draw supplementary offset current to compensate for any transients.

Holding current circuit 920 of FIG. 19 thus performs the dual function of drawing supplementary offset current at the leading edge of a phase-cut waveform (in response to the control voltage from node 916A), and supplementing the current drawn through load 918 when the current through load 918 falls below the holding current (e.g. at the trailing edge of a phase-cut waveform). The supplementary offset current and the supplementary current drawn when the current through load 918 falls below the holding current may have different magnitudes in some embodiments. For example, diodes $D_4$ and $D_5$ may be selected to have different characteristics than diodes $D_{44}$ and $D_{45}$. In some embodiments, circuit 900 may be configured such that the supplementary offset current drawn at the leading edge of the phase-cut waveform is greater than the supplementary current drawn when the current through load 918 falls below the holding current. For example, by selecting appropriate components for circuit 900, when the current through load 918 falls below the holding current, transistor $Q_{92}$ only partially turns off and transistor $Q_{41}$ only partially turns on, such that the supplementary current drawn is limited by both transistor $Q_{41}$ and resistor $R_{43}$, whereas when the leading edge signal is received, transistor $Q_{92}$ turns fully off and transistor $Q_{41}$ turns fully on, such that the supplementary offset current is limited only by resistor $R_{43}$.

Figure 20:
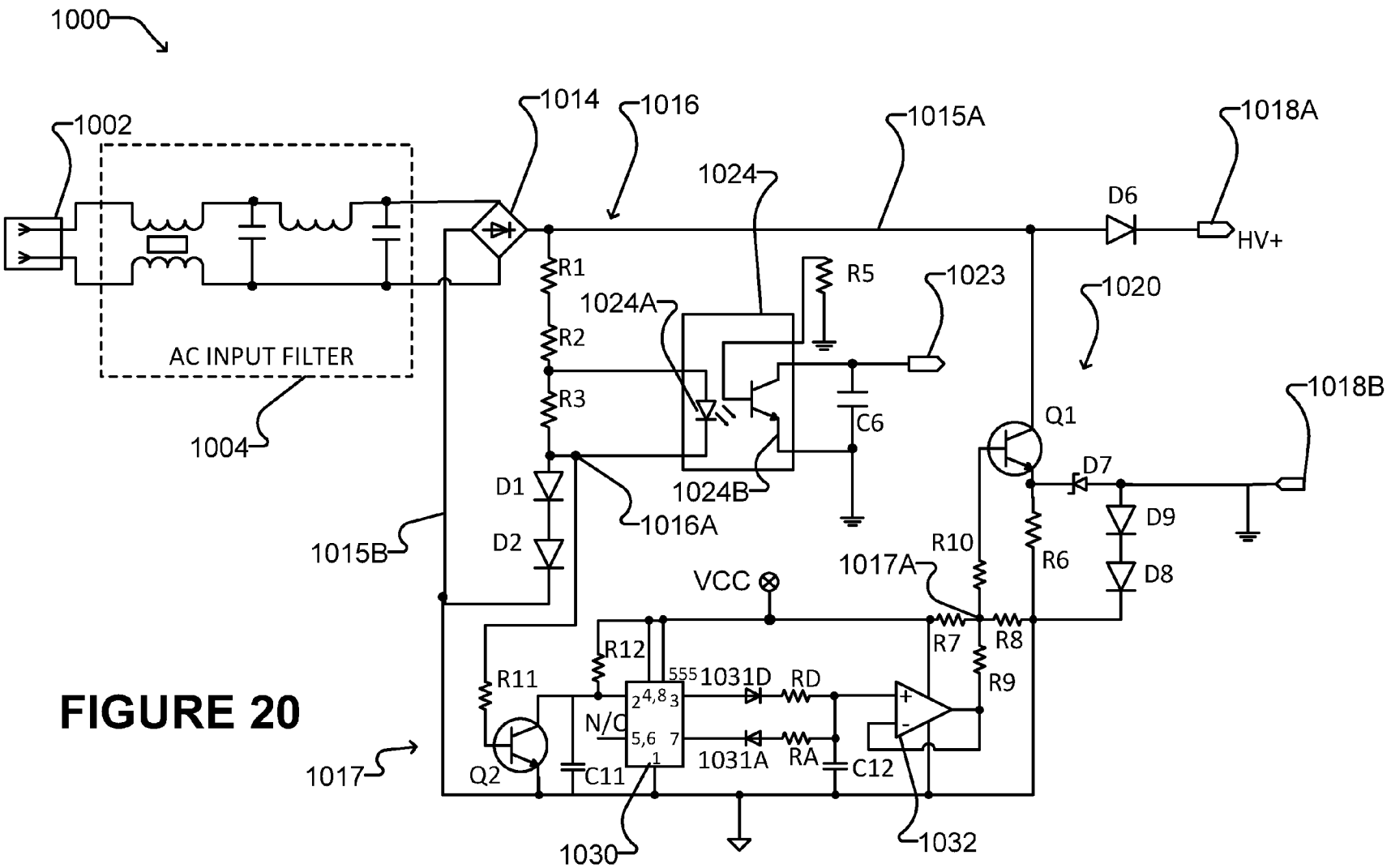
FIG. 20 is a schematic of an electrical circuit comprising an edge pulse generator and a holding current circuit according to an example embodiment.

FIG. 20 is a schematic of an example electrical circuit 1000 comprising an input 1002 connectable to receive a dimmer modulated voltage, and positive and negative load terminals 1018A and 1018B connectable to a load (not shown). An optional input filter 1004 filters the input voltage before passing it to a rectifier 1014.

An edge detector 1016 formed by resistors R1, R2 and R3 provides a voltage spike at node 1016A when a leading edge of a phase-cut waveform is provided to rails 1015A and 1015B. Optocoupler 1024 comprising LED 1024A and phototransistor 1024B provide isolated duty cycle information at duty cycle terminal 1023 in a similar manner to as described above with respect to FIGS. 13A and 13B. Diodes D1 and D2 provide a reference voltage to node 1016A.

Node 1016A provides a voltage spike at the leading edge of a phase-cut waveform to a pulse shaper 1017. Pulse shaper 1017A transforms the voltage from node 1016A to produce a desired current offset waveform at node 1017A having a period determined by the waveform provided to input 1002 (e.g., when connected to a dimmer circuit having a 60 Hz AC power supply, the period of the desired current offset waveform would be 120 Hz). In some embodiments, the desired current offset waveform may be generally sawtooth-like, with a decay selected based on the expected transient envelope. In the illustrated embodiment, pulse shaper 1017 comprises resistors R7, R9, R11, R12, RA and RD, transistor Q2, capacitors C11 and C12, timer chip 1030, diodes 1031A and 1031D, and op-amp 1032. A power supply connection VCC is provided between resistors R7 and R12, which may connect to any suitable power conditioning circuitry. The power conditioning circuitry may, for example, be coupled to provide power from supply rails 1015A and 1015B.

A holding current circuit 1020 receives the current offset waveform at node 1017A and draws supplementary current in response thereto. In the illustrated embodiment, holding current circuit 1020 comprises transistor Q1, resistors R6, R8 and R10, diodes D8 and D9 and Schottkey diode D7. The current offset waveform is provided through resistor R10 to the base of transistor Q1, and the emitter of transistor Q1 is provided with a substantially stable voltage when diodes D8 and D9 are conducting, such that transistor Q1 draws supplementary offset current based on the current offset waveform. Holding current circuit 1020 may also draw current whenever the current drawn by the load (not shown) falls below a predetermined level, in a manner similar to the examples discussed above.

Variations on the example embodiments disclosed herein are within the scope of the invention, including:

A holding current circuit may be configured for control based on a portion of the load current drawn by the load. For example, a holding current circuit may be connectable to a current divider to receive a portion of the current drawn by the load, and the holding current circuit may be configured to draw an appropriate holding current based on the partial load current (e.g., the effect of a current divider may be compensated by the configuration of components comprised in the holding current circuit).

A holding current circuit may be configured for control based on a portion the current drawn by the controlled current source. For example, a holding current circuit may be connectable to a current divider to receive a portion of the current drawn by the controlled current source, and the holding current circuit may be configured to draw an appropriate holding current based on the partial controllable current (e.g., the effect of a current divider may be compensated by the configuration of components comprised in the holding current circuit).

Where a component (e.g., monitor, reference, controller, converter, current source, reference signal source, feedback source, reverse polarity protector, voltage reference, subtractor, resistor, transistor, MOSFET, diode, Schottky diode, rectifier, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Those skilled in the art will appreciate that certain features of embodiments described herein may be used in combination with features of other embodiments described herein, and that embodiments described herein may be practised or implemented without all of the features ascribed to them herein. Such variations on described embodiments that would be apparent to the skilled addressee, including variations comprising mixing and matching of features from different embodiments, are within the scope of this invention.

As will be apparent to those skilled in the art in the light of the foregoing disclosure, many alterations, modifications, additions and permutations are possible in the practice of this invention without departing from the spirit or scope thereof. The embodiments described herein are only examples. Other example embodiments may be obtained, without limitation, by combining features of the disclosed embodiments. It is therefore intended that the following appended claims and claims hereafter introduced are interpreted to include all such alterations, modifications, permutations, additions, combinations and sub-combinations as are within their true spirit and scope.

What is claimed is:

1. Apparatus for maintaining at least a holding current in a leading-edge phase-cut dimmer during a period of transient voltage variations, the apparatus connectable to the dimmer and connectable to a load connected to draw current from the dimmer, the apparatus comprising:

an edge detector connected to receive a voltage from the dimmer and generate a leading-edge signal in response to a leading-edge of a phase-cut waveform; and a current offset circuit connected to receive the leading-edge signal and draw a supplementary offset current in response to the leading-edge signal, wherein the supplementary offset current is sufficient to maintain at least a holding current in the dimmer during the period of transient voltage variations;

wherein the current offset circuit comprises a holding current circuit configured to draw a supplementary current at least as great as a difference between a holding current of the dimmer and a load current when the dimmer is in conduction and the load current is less than the holding current.

2. Apparatus according to claim 1 comprising a pulse shaper connected to receive the leading edge signal and provide a control voltage having a desired current offset waveform to the current offset circuit.

3. Apparatus according to claim 2 wherein the desired current offset waveform has an envelope selected based on a transient envelope.

4. Apparatus according to claim 2 wherein the desired current offset waveform comprises a generally sawtooth-like waveform.

5. Apparatus for maintaining at least a holding current in a leading-edge phase-cut dimmer during a period of transient voltage variations, the apparatus connectable to the dimmer and connectable to a load connected to draw current from the dimmer, the apparatus comprising:

an edge detector connected to receive a voltage from the dimmer and generate a leading-edge signal in response to a leading-edge of a phase-cut waveform; and a current offset circuit connected to receive the leading-edge signal and draw a supplementary offset current in response to the leading-edge signal, wherein the supplementary offset current is sufficient to maintain at least a holding current in the dimmer during the period of transient voltage variations;

wherein the edge detector comprises a capacitor and two resistors connected in series between a pair of voltage supply rails, and wherein the leading edge signal is generated at a node between the two resistors.

6. Apparatus according to claim 5 wherein the supplementary offset current is at least a holding current of the dimmer.

7. Apparatus according to claim 5 wherein the supplementary offset current is about three times a holding current of the dimmer.

8. Apparatus according to claim 5 wherein the current offset circuit comprises a transistor and one or more resistors connected in series between a pair of voltage supply rails, wherein a base of the transistor is connected to receive the leading edge signal.

9. Apparatus for maintaining at least a holding current in a leading-edge phase-cut dimmer during a period of transient voltage variations, the apparatus connectable to the dimmer and connectable to a load connected to draw current from the dimmer, the apparatus comprising:

an edge detector connected to receive a voltage from the dimmer and generate a leading-edge signal in response to a leading-edge of a phase-cut waveform; and a current offset circuit connected to receive the leading-edge signal and draw a supplementary offset current in response to the leading-edge signal, wherein the supplementary offset current is sufficient to maintain at least a holding current in the dimmer during the period of transient voltage variations;

wherein the edge detector comprises one or more resistors and one or more diodes connected in series between a pair of voltage supply rails, and the leading edge signal is generated at a node between the one or more resistors and the one or more diodes.

10. Apparatus according to claim 9 wherein the supplementary offset current is at least a holding current of the dimmer.

11. Apparatus according to claim 9 wherein the supplementary offset current is about three times a holding current of the dimmer.

12. Apparatus according to claim 9 wherein the current offset circuit comprises a transistor and one or more resistors connected in series between a pair of voltage supply rails, wherein a base of the transistor is connected to receive the leading edge signal.

13. A method for maintaining at least a holding current in a leading-edge phase-cut dimmer during a period of transient voltage variations, the method comprising:

generating a leading-edge signal in response to a leading-edge of a phase cut waveform; and drawing a supplementary offset current from the dimmer through a current offset circuit in response to the leading-edge signal, wherein the supplementary offset current is sufficient to maintain at least a holding current in the dimmer during the period of transient voltage variations;

wherein drawing the supplementary offset current comprises providing the leading edge signal to a holding current circuit, the holding current circuit configured to draw the supplemental offset current based on the leading edge signal, and configured to draw a supplementary current at least as great as a difference between a holding current of the dimmer and a load current when the dimmer is in conduction and the load current is less than the holding current.

14. A method according to claim 13 comprising drawing at least the holding current as the supplementary offset current.

15. A method according to claim 13 comprising drawing at least three times the holding current as the supplementary offset current.

16. A method according to claim 13 wherein the supplementary offset current has an envelope shaped based on a transient envelope.

17. A method according to claim 13 wherein drawing the supplementary offset current comprises receiving a control voltage having a desired current offset waveform to the current offset circuit.

18. A method according to claim 17 wherein the desired current offset waveform has an envelope selected based on a transient envelope.

19. A method according to claim 17 wherein the desired current offset waveform comprises a generally sawtooth-like waveform.

20. Apparatus for maintaining at least a holding current in a leading-edge phase-cut dimmer, the apparatus connectable to the dimmer and connectable to a load connected to draw current from the dimmer, the apparatus comprising:

an edge detector connected to receive a voltage from the dimmer and generate a leading-edge signal in response to a leading-edge of a phase-cut waveform; and a holding current and offset circuit comprising a controlled current source connectable to draw current from the dimmer, a current monitor connected to receive at least a portion of the current drawn by the controlled current source and connectable to receive at least a portion of a load current drawn from the dimmer by the load, the current monitor operable to generate a current monitor signal indicative of a magnitude of the current in the current monitor, wherein the controlled current source is connected to receive the current monitor signal and is configured to draw a supplementary current at least as great as a difference between the holding current and the load current when the load current is less than the holding current, and wherein the holding current and offset circuit is connected to receive the leading-edge signal and draw a supplementary offset current in response to the leading-edge signal, wherein the supplementary offset current is sufficient to maintain at least a holding current in the dimmer during a period of transient voltage variations.

* * * * *